US008746369B2

(12) United States Patent
Hyde et al.

(10) Patent No.: US 8,746,369 B2
(45) Date of Patent: Jun. 10, 2014

(54) UMBILICAL TECHNIQUE FOR ROBOTIC MINERAL MOLE

(75) Inventors: Roderick A. Hyde, Redmond, WA (US); Muriel Y. Ishikawa, Livermore, CA (US); Jordin T. Kare, Seattle, WA (US); Nathan P. Myhrvold, Bellevue, WA (US); Clarence T. Tegreene, Bellevue, WA (US); Charles Whitmer, North Bend, WA (US); Lowell L. Wood, Jr., Bellevue, WA (US); Victoria Y. H. Wood, Livermore, CA (US)

(73) Assignee: Elwha LLC, Bellevue, WA (US)

( * ) Notice: Subject to any disclaimer, the term of this patent is extended or adjusted under 35 U.S.C. 154(b) by 367 days.

(21) Appl. No.: 13/200,802

(22) Filed: Sep. 30, 2011

(65) Prior Publication Data

US 2013/0081875 A1 Apr. 4, 2013

(51) Int. Cl.

| | |
|---|---|
| ***E21B 4/18*** | (2006.01) |
| ***E21B 23/14*** | (2006.01) |
| ***E21B 47/00*** | (2012.01) |
| ***E21B 49/02*** | (2006.01) |

(52) U.S. Cl.

CPC ..... *E21B 23/14* (2013.01); *E21B 47/00* (2013.01); *E21B 49/02* (2013.01)

USPC ..... 175/61; 175/106

(58) Field of Classification Search

USPC ..... 175/57, 61, 106

See application file for complete search history.

(56) References Cited

U.S. PATENT DOCUMENTS

| | | | |
|---|---|---|---|
| 3,827,512 | A | 8/1974 | Edmond |
| 4,250,972 | A | 2/1981 | Schmidt |
| 4,280,573 | A | 7/1981 | Sudnishnikov et al. |
| 4,858,703 | A | 8/1989 | Kinnan |
| 4,905,773 | A | 3/1990 | Kinnan |
| 4,923,134 | A | 5/1990 | Kinnan |
| 4,955,439 | A | 9/1990 | Kinnan |
| 5,010,965 | A | 4/1991 | Schmelzer |
| 5,031,706 | A | 7/1991 | Spektor |
| 5,226,487 | A | 7/1993 | Spektor |
| 5,467,831 | A | 11/1995 | Spektor |
| 5,947,213 | A | 9/1999 | Angle et al. |
| 6,047,784 | A | 4/2000 | Dorel |
| 6,268,911 | B1 | 7/2001 | Tubel et al. |
| 6,281,489 | B1 | 8/2001 | Tubel et al. |
| 6,531,694 | B2 | 3/2003 | Tubel et al. |
| 6,588,266 | B2 | 7/2003 | Tubel et al. |
| 6,598,687 | B2 | 7/2003 | Eppink et al. |
| 6,672,407 | B2 | 1/2004 | Streich |

(Continued)

OTHER PUBLICATIONS

PCT International Search Report; Application No. PCT/US2012/057999; Dec. 26, 2012; pp. 1-2.

(Continued)

*Primary Examiner* — William P Neuder

(57) ABSTRACT

Exemplary methods, systems and components disclosed herein provide propagation of light signals from an external source to a borehole mining mole which includes an optical/electric transducer configured to provide propulsive power for the borehole mining mole and its associated mineral prospecting tools. Some embodiments include one or more umbilicals connected from a remote source location to an onboard reel incorporated with the borehole mining mole. The umbilicals are spooled outwardly or inwardly from the onboard reel during traverse of the borehole mining mole along a path in an earthen environment.

100 Claims, 22 Drawing Sheets

(56) References Cited

U.S. PATENT DOCUMENTS

| | | | | |
|---|---|---|---|---|
| 6,772,840 | B2 | 8/2004 | Headworth | |
| 6,787,758 | B2 | 9/2004 | Tubel et al. | |
| 6,828,547 | B2 | 12/2004 | Tubel et al. | |
| 6,857,706 | B2 | 2/2005 | Hames et al. | |
| 6,943,340 | B2 | 9/2005 | Tubel et al. | |
| 6,977,367 | B2 | 12/2005 | Tubel et al. | |
| 7,040,390 | B2 | 5/2006 | Tubel et al. | |
| 7,132,819 | B1 | 11/2006 | Cope et al. | |
| 7,201,221 | B2 | 4/2007 | Tubel et al. | |
| 7,481,280 | B2 | 1/2009 | Benge et al. | |
| 7,795,877 | B2 | 9/2010 | Radtke et al. | |
| 7,938,205 | B2 | 5/2011 | Puttmann | |
| 2001/0020675 | A1 | 9/2001 | Tubel et al. | |
| 2002/0007970 | A1 | 1/2002 | Terry et al. | |
| 2005/0012036 | A1 | 1/2005 | Tubel et al. | |
| 2005/0082091 | A1 | 4/2005 | Kingsley | |
| 2005/0098350 | A1* | 5/2005 | Eppink et al. | 175/26 |
| 2006/0272809 | A1 | 12/2006 | Tubel et al. | |
| 2008/0135292 | A1 | 6/2008 | Sihler et al. | |
| 2009/0188665 | A1 | 7/2009 | Tubel et al. | |
| 2009/0206697 | A1 | 8/2009 | Marshall et al. | |
| 2009/0308656 | A1 | 12/2009 | Chitwood et al. | |
| 2010/0044103 | A1 | 2/2010 | Moxley et al. | |
| 2010/0071904 | A1 | 3/2010 | Burns et al. | |

OTHER PUBLICATIONS

PCT International Search Report; Application No. PCT/US2012/058011; Dec. 27, 2012; pp. 1-2.

Adams et al.; "The Tri-Service Site Characterization and Analysis Penetrometer System-SCAPS: Innovative Environmental Technology from Concept to Commercialization"; U.S. Army Environmental Center; Jan. 2000; 48 pages.

Benedetto, Alexandra; "Underground Solar Arrays Way Outside the Box"; Natural Gas Week; Sep. 28, 2009; 1 page; vol. 25, No. 39; Energy Intelligence for EarthSure.

Campaci et al.; "Design and Optimization of a Terrestrial Guided Mole for Deep Subsoil Exploration—Boring Performance Experimental Analyses"; Proc. of The 8$^{th}$ International Symposium on Artificial Intelligence, Robotics and Automation in Space; Aug. 2005; 8 pages.

"Drilling and Excavation Technologies for the Future"; The National Academy of Sciences; 1994; title page (2 pages), p. 63 and pp. 101-105; Washington, D.C.

Indra, Alek; "Fiber Optics in Solar Energy Applications White Paper"; AVAGO Technologies; Mar. 17, 2010; 6 pages.

Kubota et al.; "Study on Mole-Typed Deep Driller Robot for Subsurface Exploration"; Proceedings of the 2005 IEEE International Conference on Robotics and Automation; Apr. 2005; pp. 1297-1302; IEEE.

Nagaoka et al.; "Drilling Mechanism of Autonomous Burrowing Robot for Lunar Subsurface Exploration"; Proceedings of the 9$^{th}$ International Symposium on Artificial Intelligence, Robotics and Automation in Space; 2008; 8 pages.

Suomela et al.; "A Robotic Deep Driller for Exobiology"; Proceedings of the 6$^{th}$ International Symposium on Artificial Intelligence and Robotics & Automation in Space; Jun. 18-22, 2001; pp. 1-5; Canadian Space Agency.

"Supervision® Borehole System;" IPEK; printed on Jun. 29, 2011; 3 pages; located at http://www.ipek.at/index.pho?id=215.

* cited by examiner

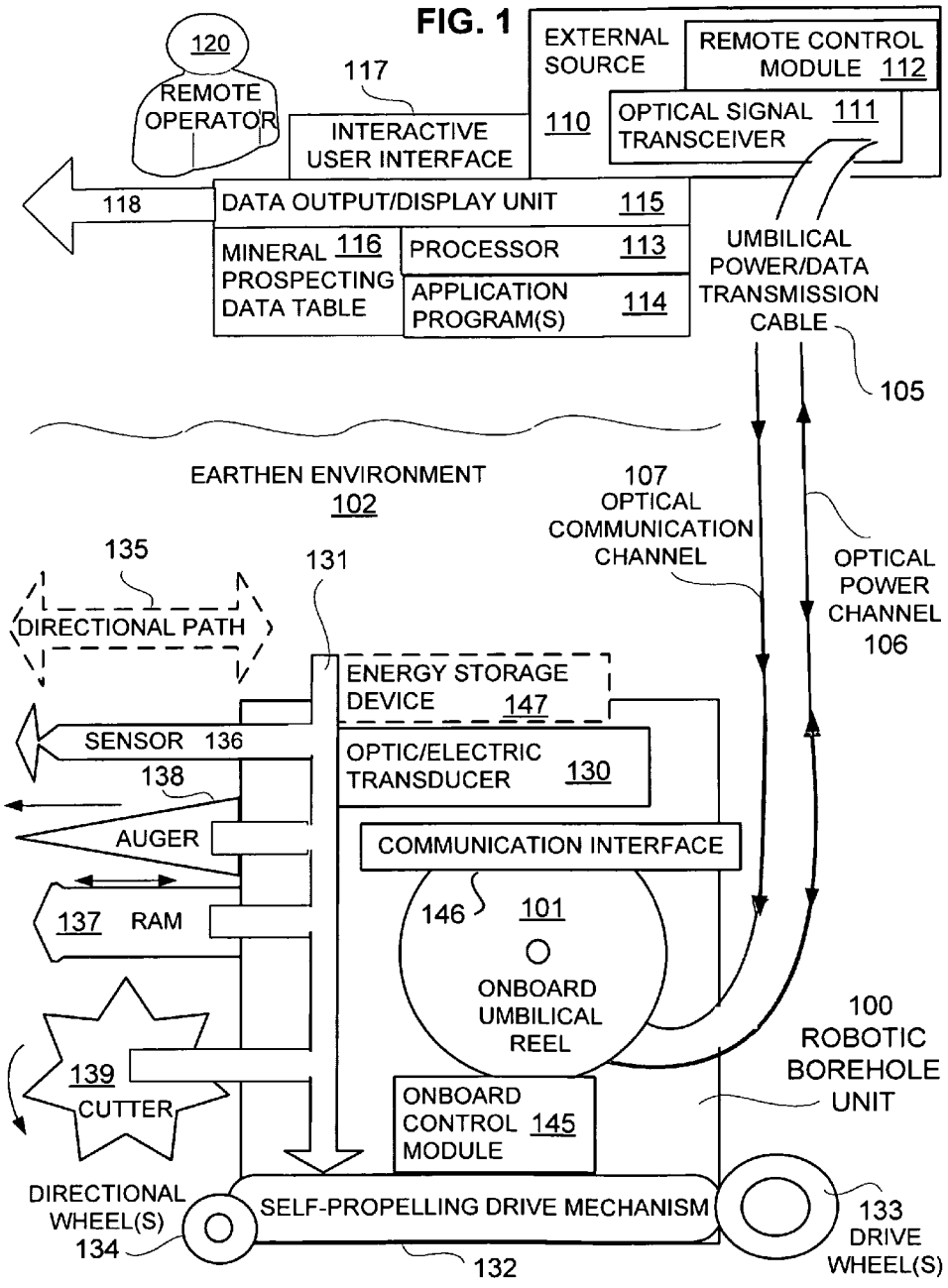
FIG. 1
120
REMOTE OPERATOR
117
INTERACTIVE USER INTERFACE
EXTERNAL SOURCE
110
REMOTE CONTROL MODULE 112
OPTICAL SIGNAL TRANSCEIVER 111
118
DATA OUTPUT/DISPLAY UNIT 115
MINERAL PROSPECTING DATA TABLE 116
PROCESSOR 113
APPLICATION PROGRAM(S) 114
UMBILICAL POWER/DATA TRANSMISSION CABLE
105
EARTHEN ENVIRONMENT 102
107 OPTICAL COMMUNICATION CHANNEL
OPTICAL POWER CHANNEL 106
135
DIRECTIONAL PATH
131
ENERGY STORAGE DEVICE 147
SENSOR 136
OPTIC/ELECTRIC TRANSDUCER 130
138
AUGER
COMMUNICATION INTERFACE
137 RAM
146
101
ONBOARD UMBILICAL REEL
100 ROBOTIC BOREHOLE UNIT
139
CUTTER
ONBOARD CONTROL MODULE 145
DIRECTIONAL WHEEL(S) 134
SELF-PROPELLING DRIVE MECHANISM
132
133 DRIVE WHEEL(S)

200

FIG. 3

UPDATED DATA TABLE FOR MINERAL PROSPECTING ACTIVITIES

| PARAMETER CATEGORY 205 | FIRST 230 WORKPLACE | SECOND 232 WORKPLACE | THIRD 234 WORKPLACE | FOURTH 236 WORKPLACE | FIFTH 238 WORKPLACE |
|---|---|---|---|---|---|
| ALTITUDE 211 | | | | | |
| GEOGRAPHIC COORDINATES 212 | | | | | |
| SPHERICAL DIRECTIONAL BEARING 213 | | | | | |
| ORE TYPE FOUND 214 | | | | | |
| MINERAL(S) DETECTED 215 | | | | | |
| AMOUNT (trace,med, high) 216 | | | | | |
| ASSAY TEST TYPE 217 | | | | | |
| EXCAVATION TOOL(S) 218 | | | | | |
| BOREHOLE UNIT DATE & TIME 219 | | | | | |

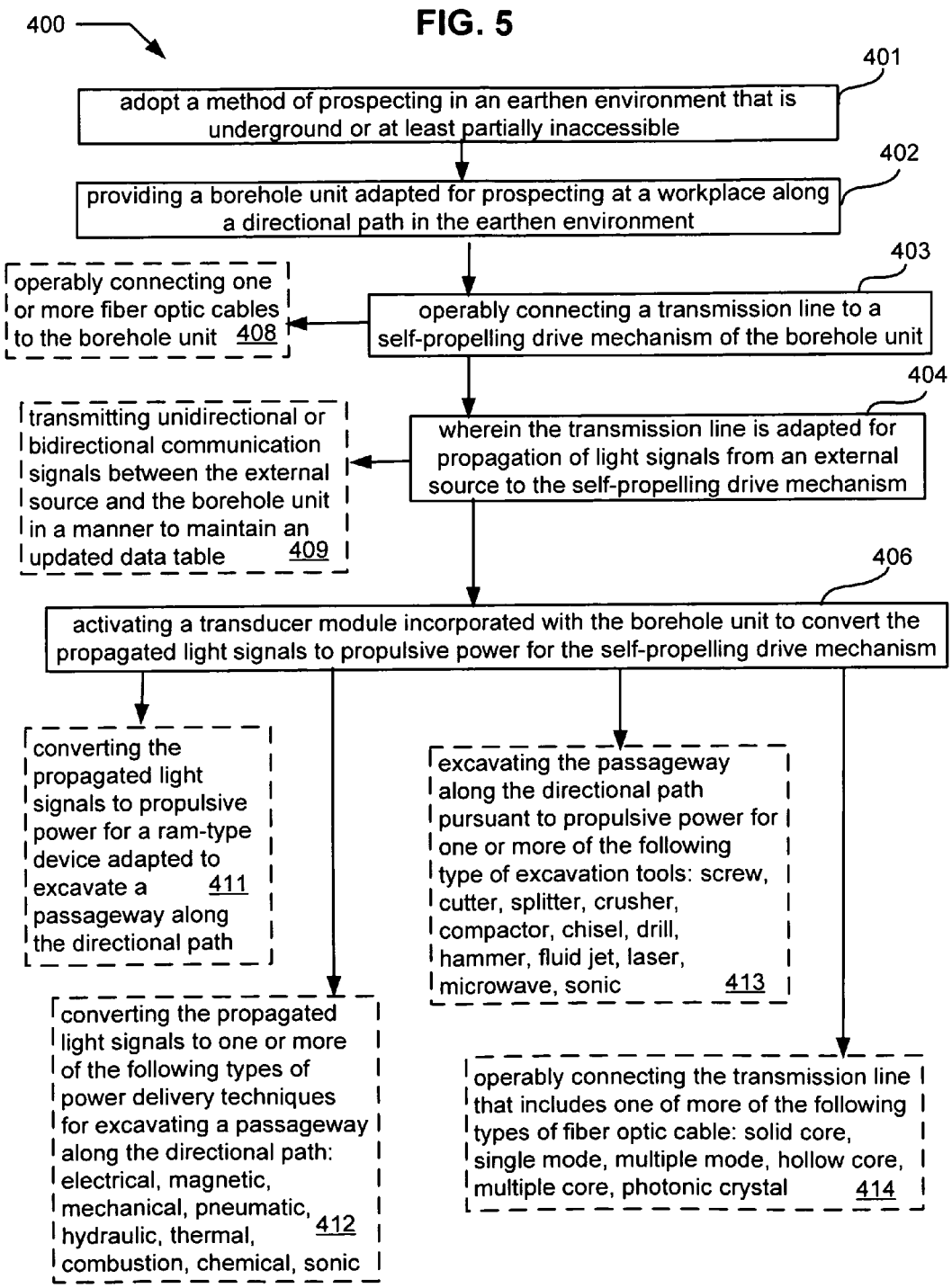
400
FIG. 5
401
adopt a method of prospecting in an earthen environment that is underground or at least partially inaccessible
402
providing a borehole unit adapted for prospecting at a workplace along a directional path in the earthen environment
403
operably connecting a transmission line to a self-propelling drive mechanism of the borehole unit
operably connecting one or more fiber optic cables to the borehole unit 408
404
wherein the transmission line is adapted for propagation of light signals from an external source to the self-propelling drive mechanism
transmitting unidirectional or bidirectional communication signals between the external source and the borehole unit in a manner to maintain an updated data table 409
406
activating a transducer module incorporated with the borehole unit to convert the propagated light signals to propulsive power for the self-propelling drive mechanism
converting the propagated light signals to propulsive power for a ram-type device adapted to excavate a passageway along the directional path 411
excavating the passageway along the directional path pursuant to propulsive power for one or more of the following type of excavation tools: screw, cutter, splitter, crusher, compactor, chisel, drill, hammer, fluid jet, laser, microwave, sonic 413
converting the propagated light signals to one or more of the following types of power delivery techniques for excavating a passageway along the directional path: electrical, magnetic, mechanical, pneumatic, hydraulic, thermal, combustion, chemical, sonic 412
operably connecting the transmission line that includes one of more of the following types of fiber optic cable: solid core, single mode, multiple mode, hollow core, multiple core, photonic crystal 414

UMBILICAL TECHNIQUE FOR ROBOTIC MINERAL MOLE

CROSS-REFERENCE TO RELATED APPLICATIONS

The present application is related to and claims the benefit of the earliest available effective filing date(s) from the following listed application(s) (the "Related Applications") (e.g., claims earliest available priority dates for other than provisional patent applications or claims benefits under 35 USC §119(e) for provisional patent applications, for any and all parent, grandparent, great-grandparent, etc. applications of the Related Application(s)). All subject matter of the Related Applications and of any and all parent, grandparent, great-grandparent, etc. applications of the Related Applications is incorporated herein by reference to the extent such subject matter is not inconsistent herewith.

RELATED APPLICATIONS

For purposes of the USPTO extra-statutory requirements, the present application constitutes a continuation-in-part of U.S. patent application Ser. No. 13/200,801 entitled OPTICAL POWER FOR SELF-PROPELLED MINERAL MOLE, naming Roderick A. Hyde, Jordin T. Kare, Nathan P. Myhrvold, Clarence T. Tegreene, Charles Whitmer, Lowell L. Wood, Jr. as inventors, filed 30 Sep. 2011, which is currently co-pending, or is an application of which a currently co-pending application is entitled to the benefit of the filing date.

The United States Patent Office (USPTO) has published a notice to the effect that the USPTO's computer programs require that patent applicants reference both a serial number and indicate whether an application is a continuation, continuation-in-part, or divisional of a parent application. Stephen G. Kunin, *Benefit of Prior-Filed Application*, USPTO Official Gazette Mar. 18, 2003. The present Applicant Entity (hereinafter "Applicant") has provided above a specific reference to the application(s) from which priority is being claimed as recited by statute. Applicant understands that the statute is unambiguous in its specific reference language and does not require either a serial number or any characterization, such as "continuation" or "continuation-in-part," for claiming priority to U.S. patent applications. Notwithstanding the foregoing, Applicant understands that the USPTO's computer programs have certain data entry requirements, and hence Applicant has provided designation(s) of a relationship between the present application and its parent application(s) as set forth above, but expressly points out that such designation(s) are not to be construed in any way as any type of commentary and/or admission as to whether or not the present application contains any new matter in addition to the matter of its parent application(s).

BACKGROUND

The present application relates to mineral prospecting activities, including monitoring and control devices and related methods, systems, components, apparatus, computerized elements, data processing modules, computer-readable media, and communication techniques.

SUMMARY

In one aspect, an exemplary method for prospecting in an earthen environment that is underground or at least partially inaccessible may include providing a borehole unit for prospecting activity at a workplace along a directional path in the earthen environment; operably connecting an umbilical to the borehole unit, wherein the umbilical is adapted to incorporate one or more types of linkage between an external source and the borehole unit; and mounting the umbilical on an onboard reel incorporated with the borehole unit. A related method feature may include extending or shortening the umbilical while the borehole unit traverses along the directional path.

In one or more various aspects, related systems and apparatus include but are not limited to circuitry and/or programming for effecting the herein-referenced method aspects; the circuitry and/or programming can be virtually any combination of hardware, software, and/or firmware configured to effect the herein-referenced method aspects depending upon the design choices of the system designer.

In another aspect, an exemplary system includes but is not limited to computerized components regarding umbilical mining techniques in an earthen environment, which system has the capability to implement the various process features disclosed herein. Examples of various system and apparatus aspects are described in the claims, drawings, and text forming a part of the present disclosure.

Some system embodiments may provide a robotic-type system for mineral prospecting that includes a control unit adapted for management and/or monitoring of a self-propelled borehole unit that is configured to perform prospecting activity at a workplace along a directional path in an earthen environment; an umbilical operably connected from an external source to the self-propelled borehole unit, wherein the umbilical includes one or more types of functional linkage components coupled with the self-propelled borehole unit; and an onboard reel incorporated with the self-propelled borehole unit and configured to carry the umbilical in a manner to enable extending or shortening the umbilical without causing significant relative movement of the umbilical during travel of the self-propelled borehole unit along the directional path.

Other system embodiments may provide apparatus for use in an earthen environment that is underground or at least partially inaccessible, wherein a borehole unit includes a self-propelling drive mechanism for prospecting activity at a workplace along a directional path in the earthen environment; an umbilical operably connected to borehole unit, wherein the umbilical is adapted to incorporate one or more types of linkage between an external source and the borehole unit; and an onboard reel incorporated with the borehole unit and configured to carry the umbilical in a manner to enable extending or shortening the umbilical while the borehole unit traverses along the directional path.

In a further aspect, a computer program product may provide computer-readable media having encoded instructions for executing a method that includes implementing management and control of a self-propelled borehole unit and/or one or more of its associated tools to perform an excavation or sampling or assay or navigation function along the directional path in the earthen environment, and during the aforesaid functions extending or shortening an umbilical housed on an onboard reel incorporated with the self-propelled borehole unit.

In addition to the foregoing, various other method and/or system and/or program product aspects are set forth and described in the teachings such as text (e.g., claims and/or detailed description) and/or drawings of the present disclosure.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE FIGURES

FIGS. 1-2 are schematic block diagrams illustrating exemplary embodiment features for optical signal transmission to a robotic mining unit.

FIG. 3 depicts an example of a data table for mineral prospecting activities by a robotic mining unit.

FIG. 5 is a high level flow chart for exemplary process aspects regarding power delivery to a borehole unit adapted for mineral prospecting.

DETAILED DESCRIPTION

Figure 2:
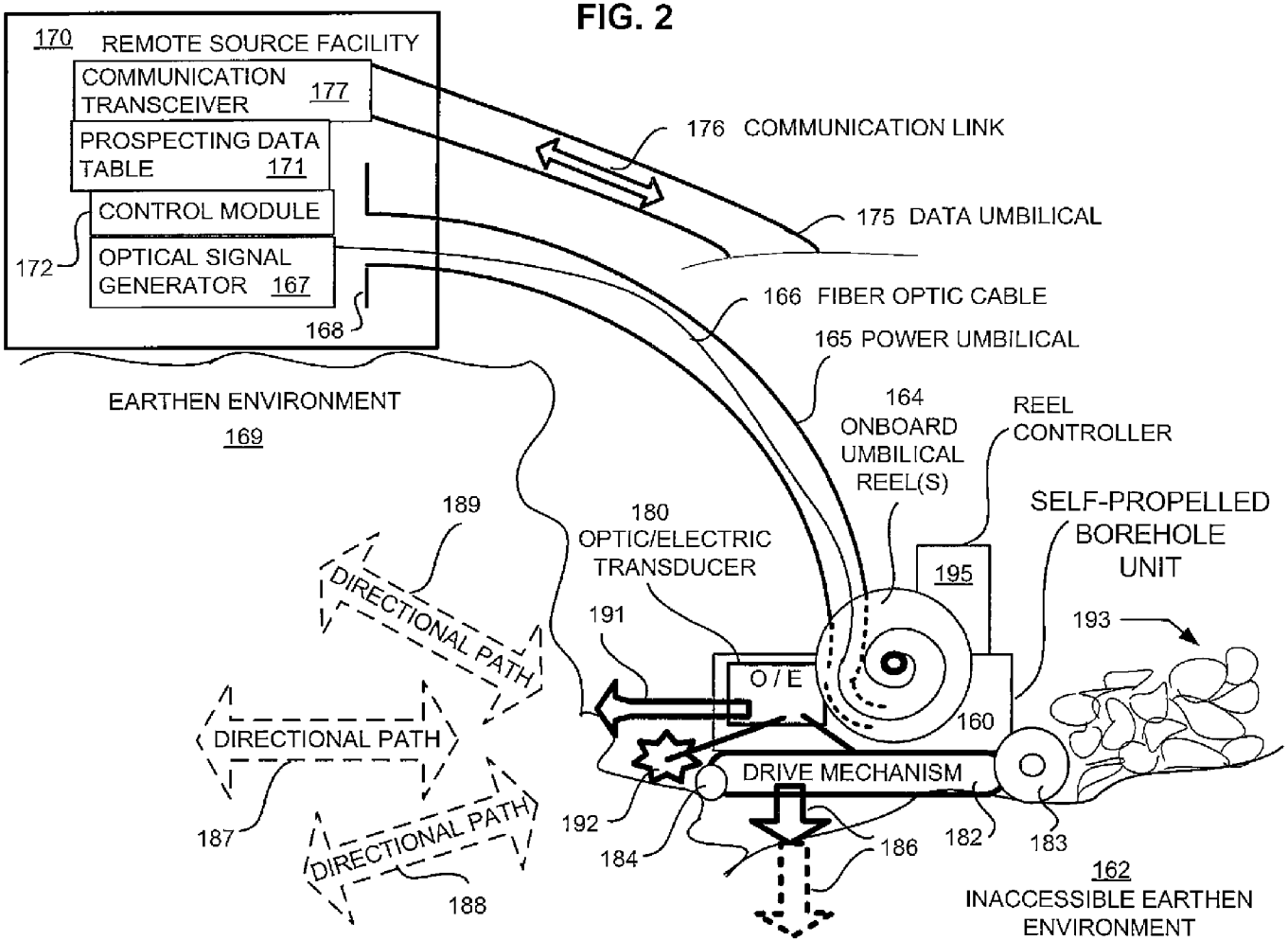

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Those having skill in the art will recognize that the state of the art has progressed to the point where there is little distinction left between hardware, software, and/or firmware implementations of aspects of systems; the use of hardware, software, and/or firmware is generally (but not always, in that in certain contexts the choice between hardware and software can become significant) a design choice representing cost vs. efficiency tradeoffs. Those having skill in the art will appreciate that there are various vehicles by which processes and/or systems and/or other technologies described herein can be effected (e.g., hardware, software, and/or firmware), and that the preferred vehicle will vary with the context in which the processes and/or systems and/or other technologies are deployed. For example, if an implementer determines that speed and accuracy are paramount, the implementer may opt for a mainly hardware and/or firmware vehicle; alternatively, if flexibility is paramount, the implementer may opt for a mainly software implementation; or, yet again alternatively, the implementer may opt for some combination of hardware, software, and/or firmware. Hence, there are several possible vehicles by which the processes and/or devices and/or other technologies described herein may be effected, none of which is inherently superior to the other in that any vehicle to be utilized is a choice dependent upon the context in which the vehicle will be deployed and the specific concerns (e.g., speed, flexibility, or predictability) of the implementer, any of which may vary. Those skilled in the art will recognize that optical aspects of implementations will typically employ optically-oriented hardware, software, and or firmware.

In some implementations described herein, logic and similar implementations may include software or other control structures. Electronic circuitry, for example, may have one or more paths of electrical current constructed and arranged to implement various functions as described herein. In some implementations, one or more media may be configured to bear a device-detectable implementation when such media hold or transmit device detectable instructions operable to perform as described herein. In some variants, for example, implementations may include an update or modification of existing software or firmware, or of gate arrays or programmable hardware, such as by performing a reception of or a transmission of one or more instructions in relation to one or more operations described herein. Alternatively or additionally, in some variants, an implementation may include special-purpose hardware, software, firmware components, and/or general-purpose components executing or otherwise invoking special-purpose components. Specifications or other implementations may be transmitted by one or more instances of tangible transmission media as described herein, optionally by packet transmission or otherwise by passing through distributed media at various times.

Alternatively or additionally, implementations may include executing a special-purpose instruction sequence or invoking circuitry for enabling, triggering, coordinating, requesting, or otherwise causing one or more occurrences of virtually any functional operations described herein. In some variants, operational or other logical descriptions herein may be expressed as source code and compiled or otherwise invoked as an executable instruction sequence. In some contexts, for example, implementations may be provided, in whole or in part, by source code, such as C++, or other code sequences.

In other implementations, source or other code implementation, using commercially available and/or techniques in the art, may be compiled/implemented/translated/converted into a high-level descriptor language (e.g., initially implementing described technologies in C or C++ programming language and thereafter converting the programming language implementation into a logic-synthesizable language implementation, a hardware description language implementation, a hardware design simulation implementation, and/or other such similar mode(s) of expression). For example, some or all of a logical expression (e.g., computer programming language implementation) may be manifested as a Verilog-type hardware description (e.g., via Hardware Description Language (HDL) and/or Very High Speed Integrated Circuit Hardware Descriptor Language (VHDL)) or other circuitry model which may then be used to create a physical implementation having hardware (e.g., an Application Specific Integrated Circuit). Those skilled in the art will recognize how to obtain, configure, and optimize suitable transmission or computational elements, material supplies, actuators, or other structures in light of these teachings.

Those skilled in the art will recognize that it is common within the art to implement devices and/or processes and/or systems, and thereafter use engineering and/or other practices to integrate such implemented devices and/or processes and/or systems into more comprehensive devices and/or processes and/or systems. That is, at least a portion of the devices and/or processes and/or systems described herein can be integrated into other devices and/or processes and/or systems via a reasonable amount of experimentation. Those having skill in the art will recognize that examples of such other devices and/or processes and/or systems might include—as appropriate to context and application—all or part of devices and/or processes and/or systems of (a) an air conveyance (e.g., an airplane, rocket, helicopter, etc.), (b) a ground conveyance (e.g., a car, truck, locomotive, tank, armored personnel carrier, etc.), (c) a building (e.g., a home, warehouse, office, etc.), (d) an appliance (e.g., a refrigerator, a washing machine, a dryer, etc.), (e) a communications system (e.g., a networked system, a telephone system, a Voice over IP system, etc.), (f) a business entity (e.g., an Internet Service Provider (ISP) entity such as Comcast Cable, Qwest, Southwestern Bell, etc.), or (g) a wired/wireless services entity (e.g., Sprint, Cingular, Nextel, etc.), etc.

In certain cases, use of a system or method may occur in a territory or location even if components are located outside the territory or location. For example, in a distributed computing context, use of a distributed computing system may occur in a territory or location even though parts of the system may be located outside of the territory or location (e.g., relay, server, processor, signal-bearing medium, transmitting computer, receiving computer, etc. located outside the territory or location).

A sale of a system or method may likewise occur in a territory even if components of the system or method are located and/or used outside the territory. Further, implementation of at least part of a system for performing a method in one territory does not preclude use of the system in another territory.

FIG. 1 is a schematic block diagram illustrating exemplary embodiment features for providing optical signal transmission from an external source 110 via an umbilical power/data transmission cable 105 to a robotic borehole unit 100 located in an earthen environment 102. The robotic borehole unit 100 includes an onboard umbilical reel 101 adapted to spool inwardly and outwardly the umbilical power/data transmission cable as the robotic borehole unit 100 travels along a directional path 135 in the earthen environment 102.

The robotic borehole unit 100 depicted in the embodiment of FIG. 1 includes an optic/electric transducer 130 that converts the propagated optical signals generated by optical signal transceiver 111 into electric power delivered via power bus 131 to various borehole components including self-propelling drive mechanism 132 and prospecting tools 137, 138, 139, 136). The self-propelling drive mechanism 132 as well as such prospecting tools may include various types of power delivery techniques, including for example electrical, magnetic, mechanical, pneumatic, hydraulic, thermal, combustion, chemical, sonic, and/or combinations thereof. In the illustrated embodiment, the self-propelling drive mechanism 132 is coupled to one or more drive wheels 133 that are coordinated in combination with one or more directional wheels 134 to move the robotic borehole unit 100 along a random or predetermined directional path 135.

The illustrated robotic borehole unit 100 also includes various associated excavation or sampling or assay tools (e.g., see ram 137, auger drill 138, cutter 139, sensor 136) that provide additional propulsive impetus to an advance or retreat or stabilization function during various mineral prospecting activities. The power bus 131 is configured to provide a direct or indirect operational coupling to such tools depending on the appropriate power delivery techniques required for each tool.

In some embodiments, optimized power delivery is provided by an energy storage device 147 that may include a battery, fuel cell, flywheel, and/or pulsed power incorporated as part of the borehole system enhancements.

The robotic borehole unit 100 may further include an onboard control module 145 that includes hardware circuitry and/or software algorithms encoded on computer-readable media to monitor and control various simultaneous and sequential prospecting operations of the mining system components incorporated or associated with the robotic borehole unit 100.

Some system components may be located at or near the external source 110, including but not limited to the optical signal transceiver 111, remote control module 112, processor 113, and one or more application programs 114. Additional system components may further include a data output/display unit 115 (in some instances certain data may be transferred for review or processing elsewhere 118) and interactive user interface 117 accessible to a remote operator 120.

It will be understood that the umbilical power/data transmission cable 105 may be configured to provide dual transmission functionality. For example, an optical power channel 106 and an optical communication channel 107 may be implemented in various fiber optic cable embodiments that include solid core, single mode, multiple mode, hollow core, multiple core, photonic crystal, or combinations thereof. In some embodiments the umbilical transmission cable 105 may include a layer portion or cable portion adapted to increase tensile strength and enhance protection during prospecting activities.

FIG. 2 is another schematic block diagram illustrating further exemplary embodiment features for providing optical signal transmission to self-propelled borehole unit 160 from a remote source facility 170 via power umbilical 165 that includes fiber optic cable 166. The remote source facility 170 located proximate to earthen environment 169 may include an optical signal generator 167 operably coupled to the fiber optic cable 166, and may further include control module 172 and prospecting data table 171 (e.g., see FIG. 3). The exemplary embodiment of FIG. 2 also enables unidirectional and/or bidirectional data transferability to the self-propelled borehole unit 160 via data umbilical 175 that includes communication link 176 operably coupled to communication transceiver 177.

Both of the umbilicals 165, 175 are configured to be fed inwardly or outwardly from the self-propelled borehole unit 160 by operation of one or more onboard umbilical reels 164 incorporated with the self-propelled borehole unit 160. In that regard a reel controller 195 is adapted to coordinate a direction or rate or timing or restriction or locking or stress-limit for the umbilicals 165, 175 during their wind-up retrieval or un-wind release from respective onboard umbilical reels 164.

In some instances a secure fixed attachment 168 is provided at the remote source facility 170 to assure that adequate tensile strength support is provided through power umbilical 165 to the self-propelled borehole unit 160. Of course, such tensile strength support may similarly be provided through a secure attachment (not shown) for data umbilical 176, and may be helpful to achieve stabilization of the self-propelled borehole unit 160 during prospecting activities as well as to achieve its removal from inaccessible earthen environment 162 after such prospecting activities have been completed.

The illustrated self-propelled borehole unit 160 includes optic/electric transducer (O/E) 180 which converts the propagated optical signals received via fiber optic cable 166 into electrical power that is used directly or indirectly to activate drive mechanism 182 and its associated drive wheels 183 and directional wheels 184. Such electrical power may also be used directly or indirectly to activate prospecting tools 191, 192 adapted for excavation or sampling or assay or navigation activities along directional paths 187, 188, 189. Such prospecting tools may also facilitate removal of residual ore to an inactive area (see 193) in the directional passageway.

Depending on the type of prospecting activity involved, a change of direction or stabilization for self-propelled borehole unit 160 may be facilitated by one or more auxiliary support arms such as a retractable jack (e.g., see 186 attached to lower surface of self-propelled borehole unit 160) whose operation may be managed by remote control module 172 or by an onboard control module (e.g., see 145 in FIG. 1). Similar retractable jacks may be installed on upper, right side, left side, and rear portions of the self-propelled borehole unit 160 to engage adjacent passageway walls during traverse along a predetermined directional path or along a revised directional path (e.g., see 187, 188, 189) or to achieve a revised directional path based on feedback data from onboard prospecting components.

FIG. 3 depicts an example of an updated data table 200 for mineral prospecting activities along a directional path that includes multiple workplace locations including a first workplace 230, second workplace 232, third workplace 234, fourth workplace 236, and fifth workplace 238. Various parameter categories 205 may be monitored during a mineral prospecting activity by onboard prospecting components, and circuitry and/or software methodology may be implemented in order to obtain appropriate data for future reference and further processing.

Some depicted examples of parameter categories for a specifically identified workplace along the directional path traversed by a borehole unit includes altitude 211, geographic coordinates 212, and spherical directional bearing 213. This informational data will facilitate a future return to a workplace location that has potential for further prospecting and mining activities. Additional depicted examples of parameter categories include ore type found 214, one or more minerals detected 215, and an estimated amount of such detected minerals (e.g. trace, medium, high, etc.) 216 that might be extracted from the earthen ore. In some instances an assay of an ore sample may be conducted in real-time or at a subsequent time period, depending on the circumstances. In the event of such assay activity, a further parameter category may include a listing of an assay test type 217.

Further depicted examples of parameter categories include a listing of one or more excavation tools 218 that were used at the particular workplace (e.g., 230, 232, etc.). Another parameter category may include a listing of a borehole unit date and time 219 for the prospecting activity at that particular workplace.

Of course, the listed categories are for purposes of illustration only, and are not intended to be limiting. Other parameter categories may be included in such a mineral prospecting data table 200. In some instances the illustrate parameter categories may be considered to be of insufficient value and can be eliminated, depending on the circumstances.

Figure 4:
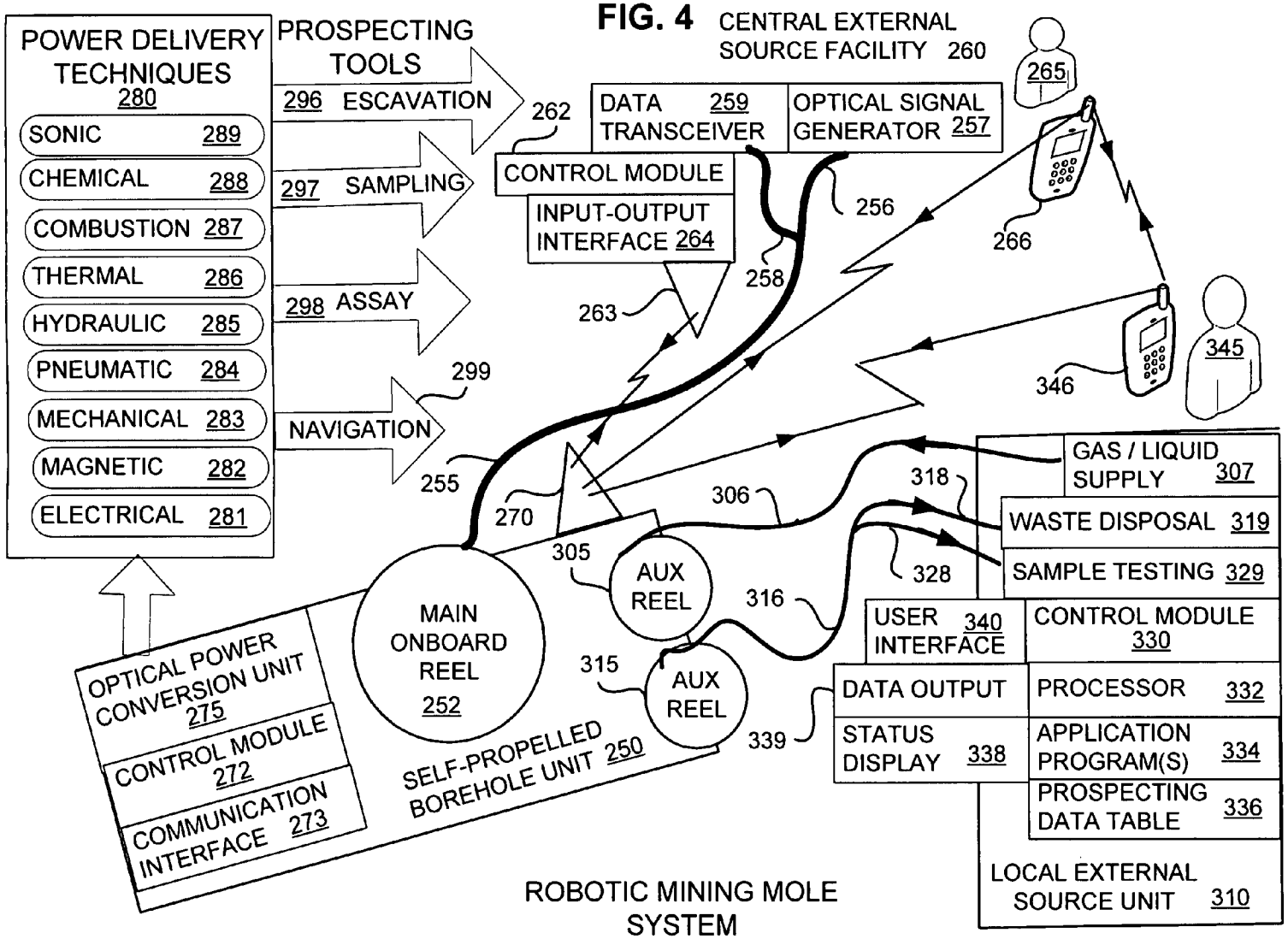
FIG. 4 illustrates further embodiment aspects for a robotic mining mole system.

The schematic block diagram of FIG. 4 illustrates further exemplary embodiment aspects that may be implemented in a robotic mining mole system. An embodiment for a self-propelled borehole unit 250 includes a main onboard reel 252 for inward/outward spooling of umbilical 255 in order to implement functional prospecting operations coordinated with a central external source facility 260 located remotely from the borehole unit 250. In that regard umbilical 255 is operably coupled to optical signal generator 257 via branch umbilical 256, and also operably coupled to data transceiver 259 via branch umbilical 258, wherein components 257, 259 are incorporated with the central external source facility 260.

The self-propelled borehole unit 250 also includes onboard control module 272, as well as communication interface 273 adapted for unidirectional and/or bidirectional data transfers via branch umbilical 258 with data transceiver 259. An optical power conversion unit 275 is configured to receive propagated optical signals via branch umbilical 256 from optical signal generator 257, wherein the resulting power output from conversion unit 275 may directly or indirectly provide the necessary operational and/or propulsive power required for various drive mechanism systems and prospecting tools. For example, appropriate power delivery techniques 280 for such drive mechanism systems and tools may include electrical 281, magnetic 282, mechanical 283, pneumatic 284, hydraulic 285, thermal 286, combustion 287, chemical 288, and sonic 289. Functional operations for prospecting tools may include various types such as excavation 296, sampling 297, assay 298 and/or navigation 299.

The embodiment for central external source facility 260 also includes control module 262, input-output interface 264, and smart transceiver (e.g., cell phone 266) accessible to a user 265, and further includes antenna 263 adapted for wireless signal transmissions with a borehole unit antenna 270.

The embodiment for self-propelled borehole unit 250 also includes onboard auxiliary reels 305, 315 that are mounted in a manner to feed inwardly and outwardly umbilicals 306, 316 which are linked with a local external source unit 310. In that regard, umbilical 306 provides a conduit link for receiving appropriate operational materials (e.g., fuel, oxidizer, reactant, lubricant, coolant, etc.) from a gas or liquid supply 307 associated with the local external source unit 310. As a further example, umbilical 316 provides a conduit link for sending certain prospecting materials to appropriate destinations associated with the local external source unit 310, including unusable byproducts via umbilical branch 318 to a waste disposal 319, as well as acquired ore or mineral particles via umbilical branch 328 to sample testing 329.

The local external source unit 310 may also include processor 332, one or more application programs 334, prospecting data table 336, and control module 330. Further components accessible to user 345 include user interface 340, data output 339, and status display 338, as well as a wireless terminal (e.g., smart transceiver 346) that provides a wireless communication link with borehole antenna 270 and with cell phone 266 associated with user 265 at the central external source facility 260.

The illustrated system and apparatus examples disclosed herein are for purposes of illustration only, and are not intended to be limiting. In that regard, the exemplary system embodiments of FIGS. 1-4 and FIGS. 13-14 provide apparatus for use in an earthen environment that is underground or at least partially inaccessible, wherein a robotic borehole unit may include a self-propelling drive mechanism for implementing prospecting activity at a workplace along a directional path in the earthen environment, along with a transmission line adapted for propagation of light signals from an external source to a self-propelling drive mechanism. A further possible system component includes a transducer module incorporated with the borehole unit for converting the propagated light signals to propulsive power for the self-propelling drive mechanism. A related aspect includes converting such propagated light signals directly or indirectly to power delivery modes and techniques appropriate for driving propulsive borehole travel as well as for driving prospecting excavation tools.

Other system components disclosed herein may enable the self-propelling drive mechanism to be linked directly or indirectly to a ram-type device adapted to excavate a passageway along the directional path. Further system components may enable conversion of the propagated light signals to appropriate types of power delivery techniques for operating various types of excavation or sampling tools such as a screw, cutter, splitter, crusher, compactor, chisel, drill, hammer, fluid jet, laser, microwave, or sonic powered device.

Some system embodiment features disclosed herein include fiber optic cable capable of transmitting unidirectional or bidirectional communication signals between the external source and the borehole unit in a manner to maintain an updated data table regarding prospecting activities, as well as to provide management control over the borehole unit and its associated excavation tools. Another system aspect may include an umbilical for supporting and/or enclosing and/or shielding and/or protecting the fiber optic cable transmission line, as well as other transmission links included in an umbilical housed on an onboard reel located on a robotic borehole unit.

Additional types of mining functions may be accomplished by a sensor tool configured to detect a presence or absence of one or more types of mineral deposit along the directional path. Some system components may include a sensor tool configured to implement prospecting activity based on one or more of the following techniques: conductivity, magnetic properties, permittivity, x-ray fluorescence, gamma rays, synthetic-aperture radar (SAR) imaging, azimuthal directivity, moisture, chemical analysis.

Some excavation tools associated with a robotic borehole unit may be configured to create a small-diameter passageway that is not capable for human traverse. A further possible system tool may be configured to perform a prospecting activity that includes an excavation or sampling or assay or navigation function without need of a proximate human operator. Some system examples disclosed herein include a tool configured to perform a prospecting activity that includes an excavation or sampling or assay or navigation function pursuant to operational control by a remote above-ground control unit or remote human operator.

A further possible system enhancement includes a robotic borehole unit that includes an auxiliary support component configured for engaging proximate passageway walls to help change excavation directions along a curved or straight or upward or downward directional path. Another system aspect disclosed herein includes a navigational or positioning device incorporated with the borehole unit and configured to keep track of the workplace and/or directional path in the earthen environment.

Additional system components disclosed herein provide an auxiliary support component that includes an umbilical physically connected to the borehole unit. A related aspect include providing the umbilical that is adapted to be spooled inwardly and outwardly from an on-board reel located on the robotic borehole unit.

Other system components may include a transducer module further adapted for converting the propagated light signals into thermal energy in a manner to enable operation of an open or closed cycle heat pump adapted to enable excavation or sampling of ore materials. A further system aspect may include a transmission line adapted for propagation of time varying light signals, and wherein a transducer module is configured to convert the time varying light signals to time varying electrical power for a self-propelling drive mechanism associated with a borehole unit. A related system component may include a transmission line adapted for propagation of multiple color light signals on one or more fiber optic channels, wherein each color light signal includes a different phase or different excitation level.

An additional system feature disclosed herein includes a transducer module adapted for converting propagated light signals into alternating current (AC) of direct current (DC) to provide electrical power to operate a self-propelled drive mechanism or to activate a sensor or assay unit or sampling device or excavation tool or navigation module.

Those skilled in the art will recognize that at least a portion of the devices and/or processes described herein can be integrated into a data processing system. Those having skill in the art will recognize that a data processing system generally includes one or more of a system unit housing, a video display device, memory such as volatile or non-volatile memory, processors such as microprocessors or digital signal processors, computational entities such as operating systems, drivers, graphical user interfaces, and applications programs, one or more interaction devices (e.g., a touch pad, a touch screen, an antenna, etc.), and/or control systems including feedback loops and control motors (e.g., feedback for sensing position and/or velocity; control motors for moving and/or adjusting components and/or quantities). A data processing system may be implemented utilizing suitable commercially available components, such as those typically found in data computing/communication and/or network computing/communication systems.

The high level flow chart of FIG. 5 depicts an illustrated embodiment for adopting a method of prospecting in an earthen environment that is underground or at least partially inaccessible (block 401). Possible method aspects include providing a borehole unit adapted for prospecting at a workplace along a directional path in the earthen environment (block 402); and operably connecting a transmission line to a self-propelling drive mechanism of the borehole unit (block 403), wherein the transmission line is adapted for propagation of light signals from an external source to the self-propelling drive mechanism (block 404). A further method aspect may include activating a transducer module incorporated with the borehole unit to convert the propagated light signals to propulsive power for the self-propelling drive mechanism (block 406).

Additional process components may include operably connecting one or more fiber optic cables to the borehole unit (block 408), and transmitting unidirectional or bidirectional communication signals between the external source and the borehole unit in a manner to maintain a data table (block 409). Another possible process aspect includes converting the propagated light signals to propulsive power for a ram-type device adapted to excavate a passageway along the directional path (block 411). A related exemplary aspect includes converting the propagated light signals to one or more of the following types of power delivery techniques for excavating a passageway along the directional path: electrical, magnetic, mechanical, pneumatic, hydraulic, thermal, combustion, chemical, sonic (block 412).

Other possible process aspects illustrated in FIG. 5 include excavating the passageway along the directional path pursuant to propulsive power for one or more of the following type of excavation tools: screw, cutter, splitter, crusher, compactor, chisel, drill, hammer, fluid jet, laser, microwave, sonic (block 413). Another process component may include operably connecting the transmission line that includes one of more of the following types of fiber optic cable: solid core, single mode, multiple mode, hollow core, multiple core, photonic crystal (block 414).

Figure 6:
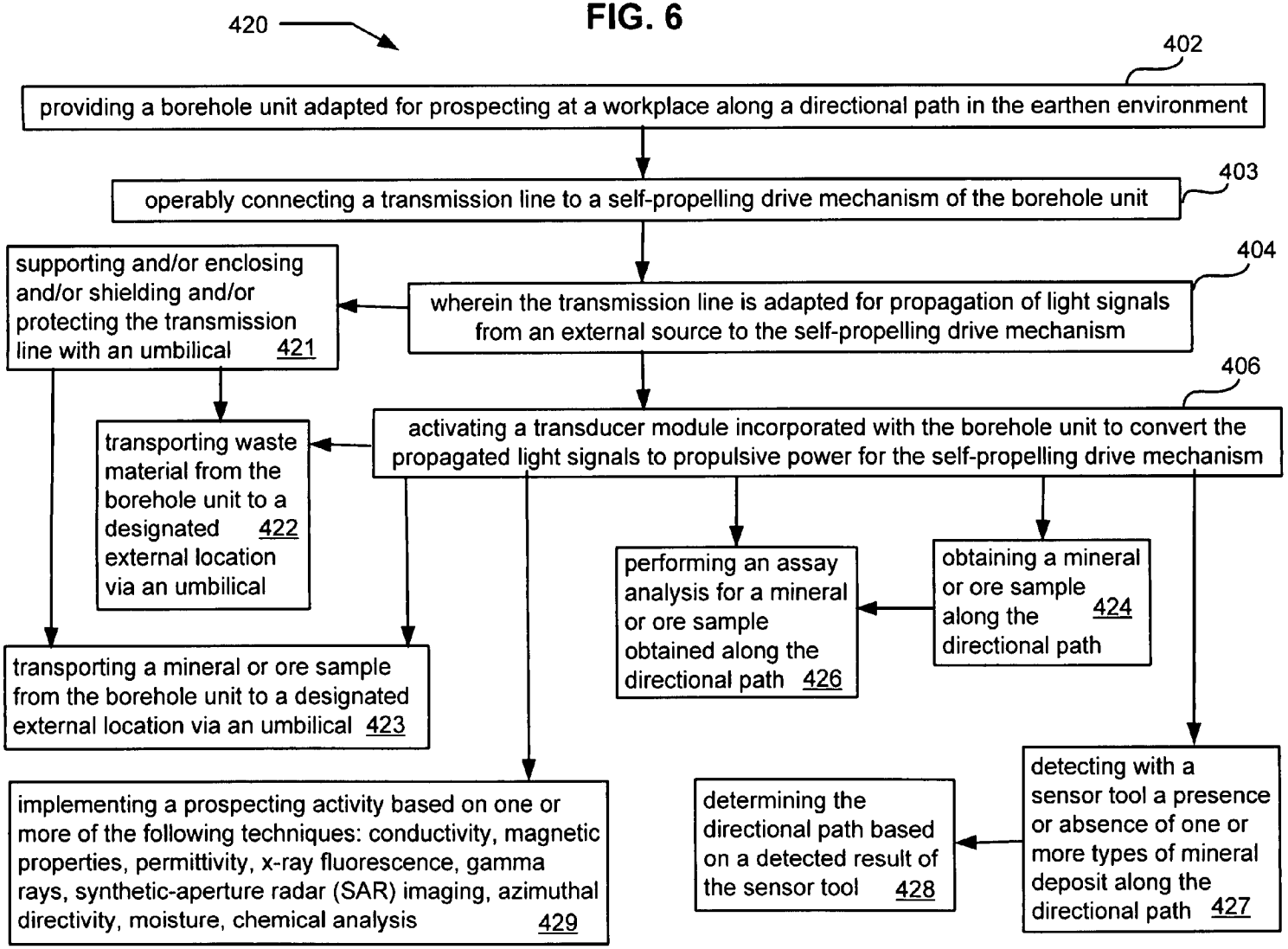
FIGS. 6-11 are more detailed flow charts illustrating further process embodiment aspects regarding remote operation of borehole mining activities.

Referring to the exemplary embodiment features 420 in FIG. 6, possible process components includes previously described features 402, 403, 404, 406 in combination with supporting and/or enclosing and/or shielding and/or protecting the transmission line with an umbilical (block 421). Further illustrated process features regarding an umbilical may include transporting waste material from the borehole unit to a designated external location via an umbilical (block 422), and transporting a mineral or ore sample from the borehole unit to a designated external location via an umbilical (block 423).

Other possible process aspects may include obtaining a mineral or ore sample along the directional path (block 424), and performing an assay analysis for a mineral or ore sample obtained along the directional path (block 426). In some instances an exemplary process may include detecting with a sensor tool a presence or absence of one or more types of mineral deposit along the directional path (block 427), and also determining the directional path based on a detected result of the sensor tool (block 428). Another process example may include implementing a prospecting activity based on one or more of the following techniques: conductivity, magnetic properties, permittivity, x-ray fluorescence, gamma rays, synthetic-aperture radar (SAR) imaging, azimuthal directivity, moisture, chemical analysis (block 429).

Figure 7:
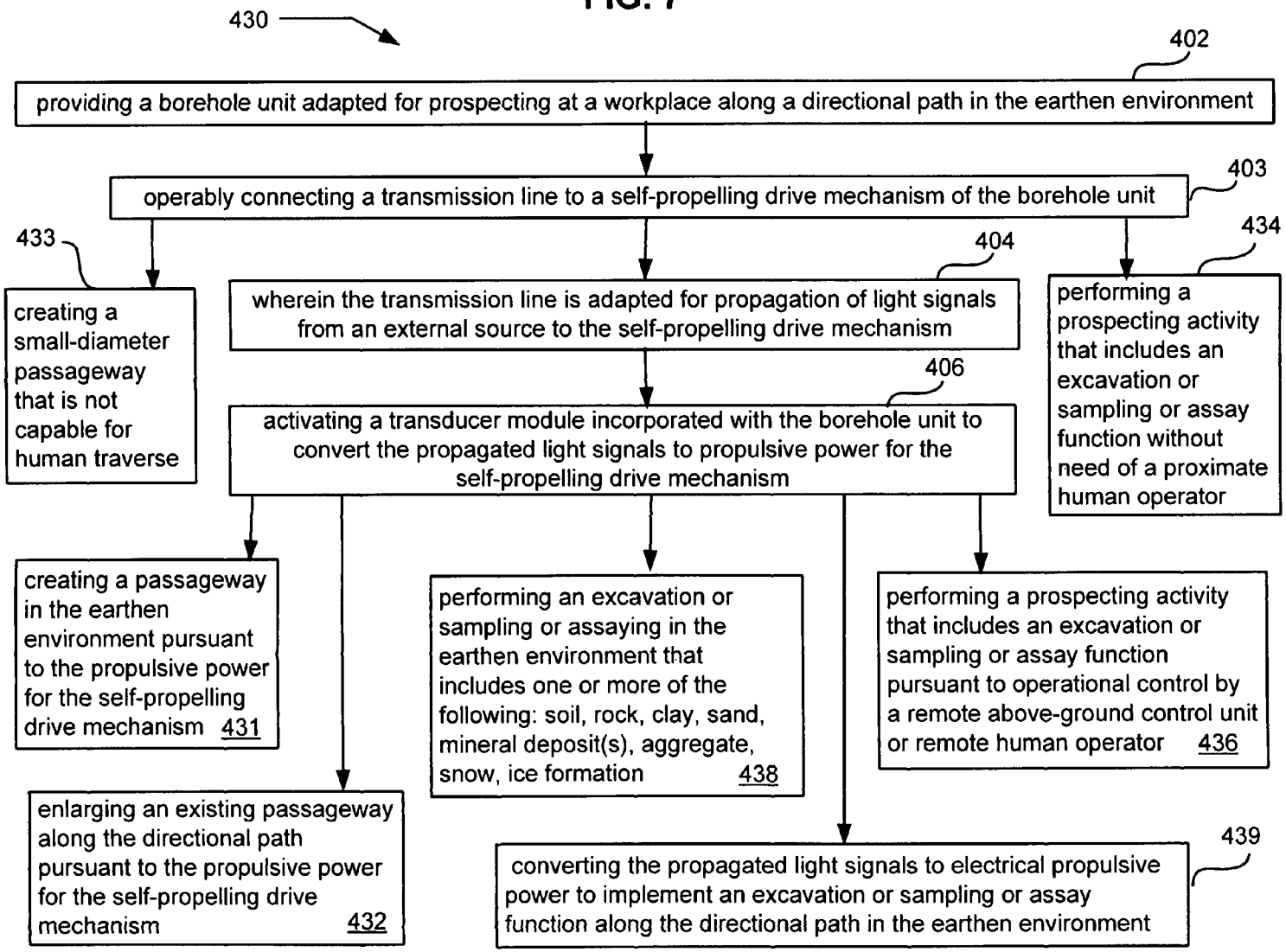

The flow chart of FIG. 7 illustrates possible embodiment aspects 430 including previously described aspects 402, 403, 404, 406 along with creating a passageway in the earthen environment pursuant to the propulsive power for the self-propelling drive mechanism (block 431). Related aspects may include enlarging an existing passageway along the directional path pursuant to the propulsive power for the self-propelling drive mechanism (block 432), and creating a small-diameter passageway that is not capable for human traverse (block 433).

Additional process examples include performing a prospecting activity that includes an excavation or sampling or assay function without need of a proximate human operator (block 434), and performing a prospecting activity that includes an excavation or sampling or assay function pursuant to operational control by a remote above-ground control unit or remote human operator (block 436). Additional illustrated process examples include performing an excavation or sampling or assaying in the earthen environment that includes one or more of the following: soil, rock, clay, sand, mineral deposit(s), aggregate, snow, ice formation (block 438). Further possible process aspects include converting the propagated light signals to electrical propulsive power to implement an excavation or sampling or assay function along the directional path in the earthen environment (block 439).

Figure 8:
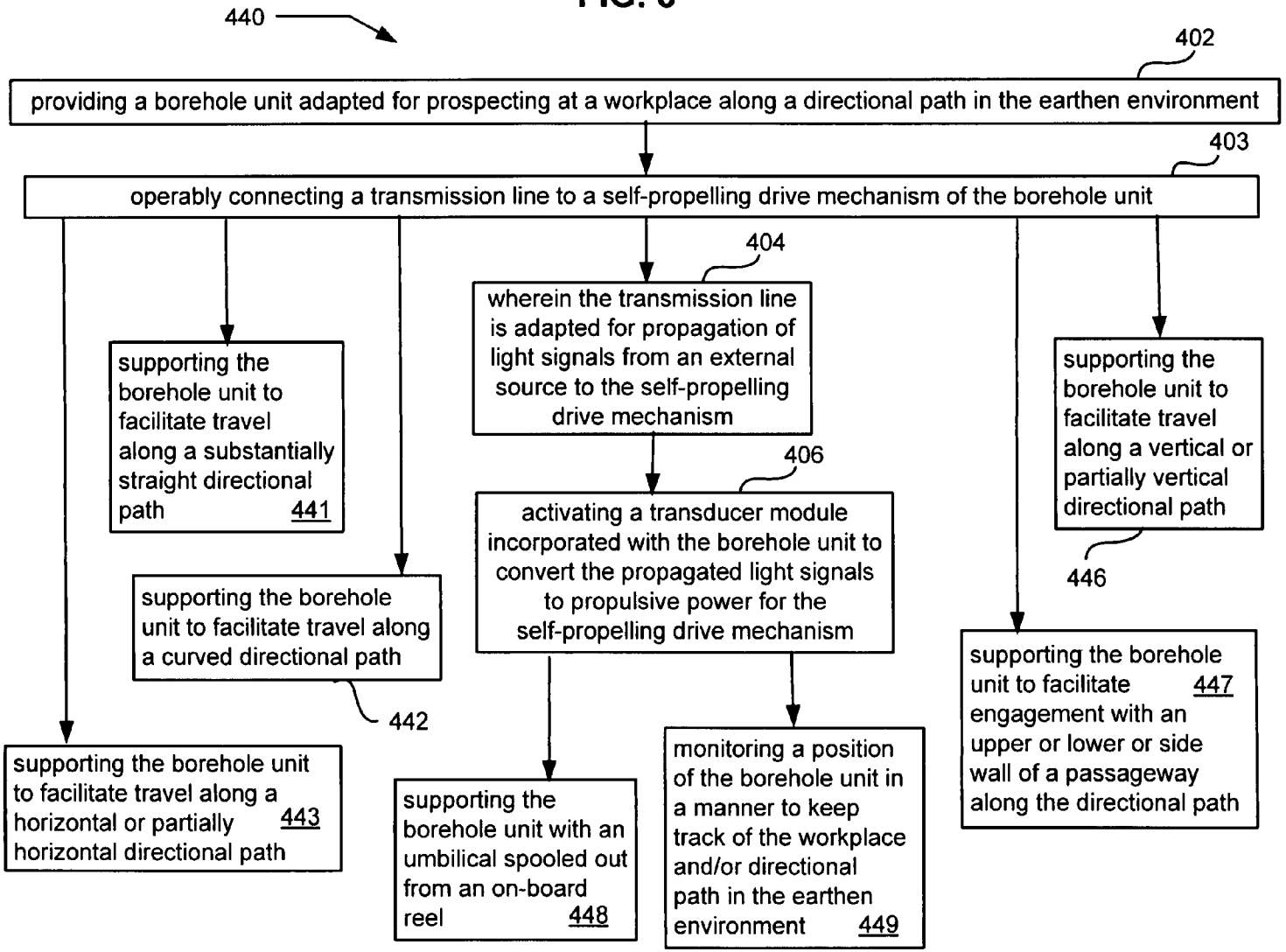

The illustrated features 440 shown in the detailed flow chart of FIG. 8 include previously described process aspects 402, 403, 404, 406 along with various examples of borehole support features such as supporting the borehole unit to facilitate travel along a substantially straight directional path (block 441) or along a curved directional path (block 442). Further related examples include supporting the borehole unit to facilitate travel along a horizontal or partially horizontal directional path (block 443), and to facilitate travel along a vertical or partially vertical directional path (block 446).

In some instances a process feature may include supporting the borehole unit to facilitate engagement with an upper or lower or side wall of a passageway along the directional path (block 447). Another possible feature may include supporting the borehole unit with an umbilical spooled out from an on-board reel (block 448). Additional exemplary features include monitoring a position of the borehole unit in a manner to keep track of the workplace and/or directional path in the earthen environment (block 449).

Figure 9:
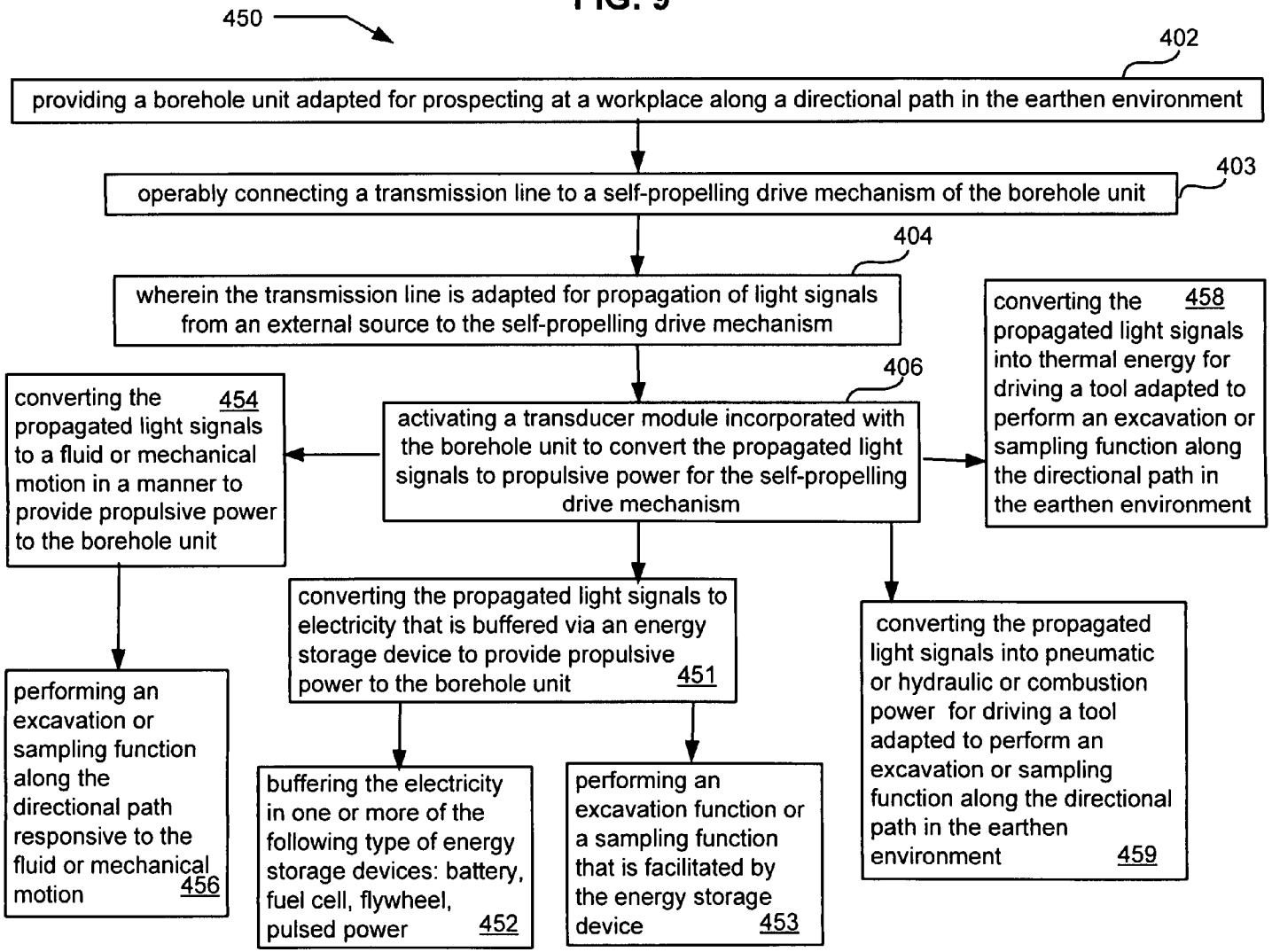

Referring to FIG. 9, various exemplary embodiment features 450 include previously described process operations 402, 403, 404, 406 as well as converting the propagated light signals to electricity that is buffered via an energy storage device to provide propulsive power to the borehole unit (block 451). Related aspects may further include buffering the electricity in one or more of the following type of energy storage devices: battery, fuel cell, flywheel, pulsed power (block 452). Other illustrated process aspects include performing an excavation function or a sampling function that is facilitated by the energy storage device (block 453).

In some instances additional process features may include converting the propagated light signals to a fluid or mechanical motion in a manner to provide propulsive power to the borehole unit (block 454). A related illustrated process feature includes performing an excavation or sampling function along the directional path responsive to the fluid or mechanical motion (block 456).

Some embodiments may include converting the propagated light signals into thermal energy for driving a tool adapted to perform an excavation or sampling function along the directional path in the earthen environment (block 458). Further aspects may include converting the propagated light signals into pneumatic or hydraulic or combustion power for driving a tool adapted to perform an excavation or sampling function along the directional path in the earthen environment (block 459).

Figure 10:
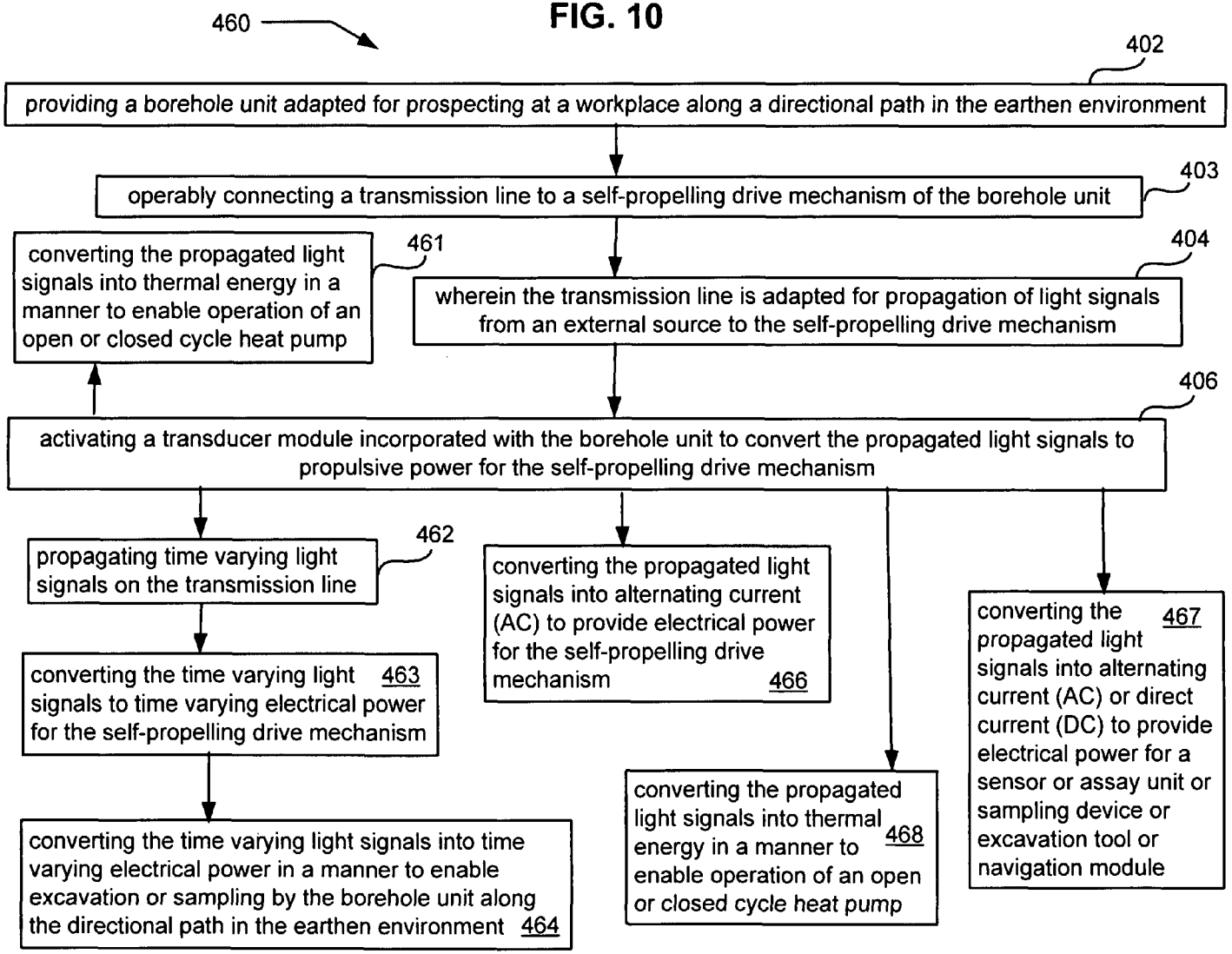

The detailed flow chart of FIG. 10 shows exemplary process features 460 that include previously described aspects 402, 403, 404, 406 in combination with propagating time varying light signals on the transmission line (block 462). A related example includes converting the time varying light signals to time varying electrical power for the self-propelling drive mechanism (block 463). A further related example includes converting the time varying light signals into time varying electrical power in a manner to enable excavation or sampling by the borehole unit along the directional path in the earthen environment (block 464).

Another process aspect may include converting the propagated light signals into alternating current (AC) to provide electrical power for the self-propelling drive mechanism (block 466). Yet another process aspect may include converting the propagated light signals into alternating current (AC) or direct current (DC) to provide electrical power for a sensor or assay unit or sampling device or excavation tool or navigation module (block 467). In some instances a process feature may include converting the propagated light signals into thermal energy in a manner to enable operation of an open or closed cycle heat pump (block 468).

Figure 11:
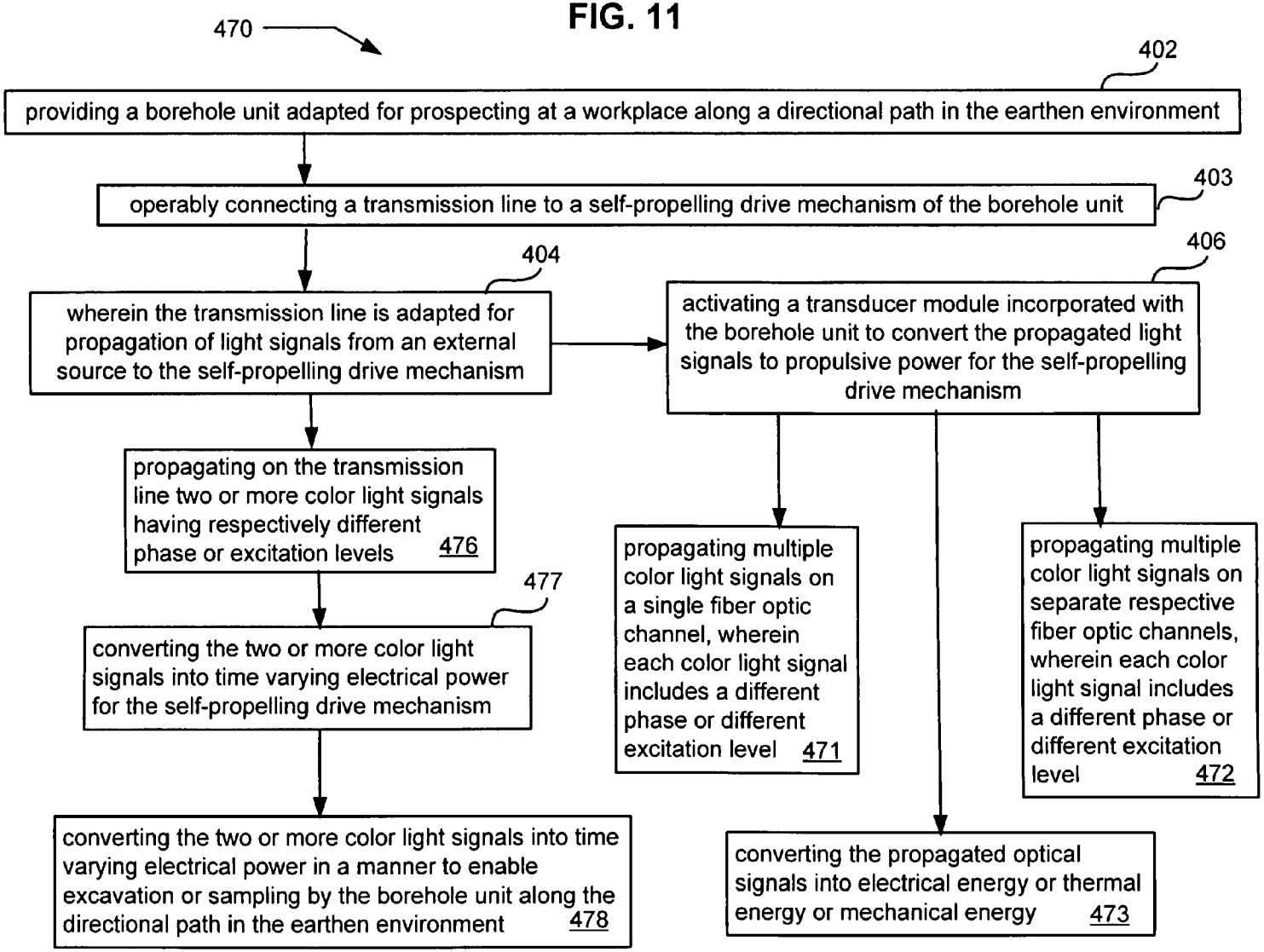

The exemplary embodiment features 470 of FIG. 11 illustrate previously described process aspects 402, 403, 404, 406 as well as propagating multiple color light signals on a single fiber optic channel, wherein each color light signal includes a different phase or different excitation level (block 471). A related process aspect includes propagating multiple color light signals on separate respective fiber optic channels, wherein each color light signal includes a different phase or different excitation level (block 472). A further aspect may include converting the propagated optical signals into electrical energy or thermal energy or mechanical energy (block 473).

In some instances an exemplary aspect may include propagating on the transmission line two or more color light signals having respectively different phase or excitation levels (block 476). Further related aspects may include converting the two or more color light signals into time varying electrical power for the self-propelling drive mechanism (block 477). Another example includes converting the two or more color light signals into time varying electrical power in a manner to enable excavation or sampling by the borehole unit along the directional path in the earthen environment (block 478).

Figure 12:
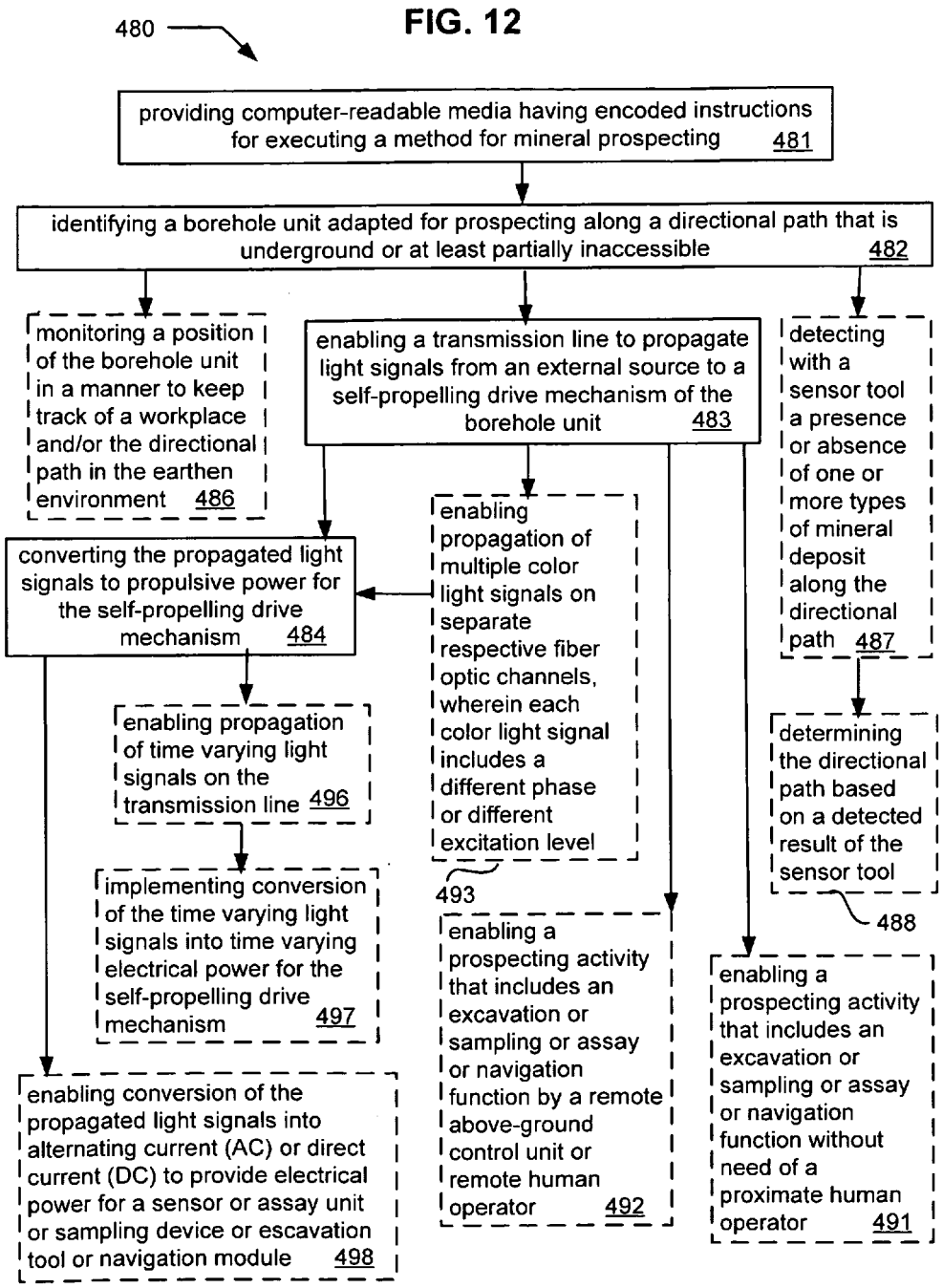
FIG. 12 is a diagrammatic flow chart for exemplary computer readable media embodiment features.

The diagrammatic flow chart features 480 shown in FIG. 12 may be incorporated in an article of manufacture which provides computer readable media having encoded instructions for executing a method for mineral prospecting (block 481), wherein the method may include identifying a borehole unit adapted for prospecting along a directional path that is underground or at least partially inaccessible (block 482), enabling a transmission line to propagate light signals from an external source to a self-propelling drive mechanism of the borehole unit (block 483), and converting the propagated light signals to propulsive power for the self-propelling drive mechanism (block 484).

Other possible programmed method features may include monitoring a position of the borehole unit in a manner to keep track of a workplace and/or the directional path in the earthen environment (block 486). Additional programmed aspects may include detecting with a sensor tool a presence or absence of one or more types of mineral deposit along the directional path (block 487), and in some instances determining the directional path based on a detected result of the sensor tool (block 488).

Further exemplary programmed aspects include enabling a prospecting activity that includes an excavation or sampling or assay or navigation function without need of a proximate human operator (block 491). Another programmed method example includes enabling a prospecting activity that includes an excavation or sampling or assay or navigation function by a remote above-ground control unit or remote human operator (block 492).

Some programmed method aspects may also include enabling propagation of multiple color light signals on separate respective fiber optic channels, wherein each color light signal includes a different phase or different excitation level (block 493). Other programmed method possibilities include enabling propagation of time varying light signals on the transmission line (block 496). A related programmed aspect may include implementing conversion of the time varying light signals into time varying electrical power for the self-propelling drive mechanism (block 497). In some instances another programmed method feature may include enabling conversion of the propagated light signals into alternating current (AC) or direct current (DC) to provide electrical power for a sensor or assay unit or sampling device or excavation tool or navigation module (block 498).

It will be understood that numerous individual method operations depicted in the flow charts of FIGS. 5-11 can be incorporated as encoded instructions in computer readable media in order to obtain enhanced benefits and advantages.

Figure 13:
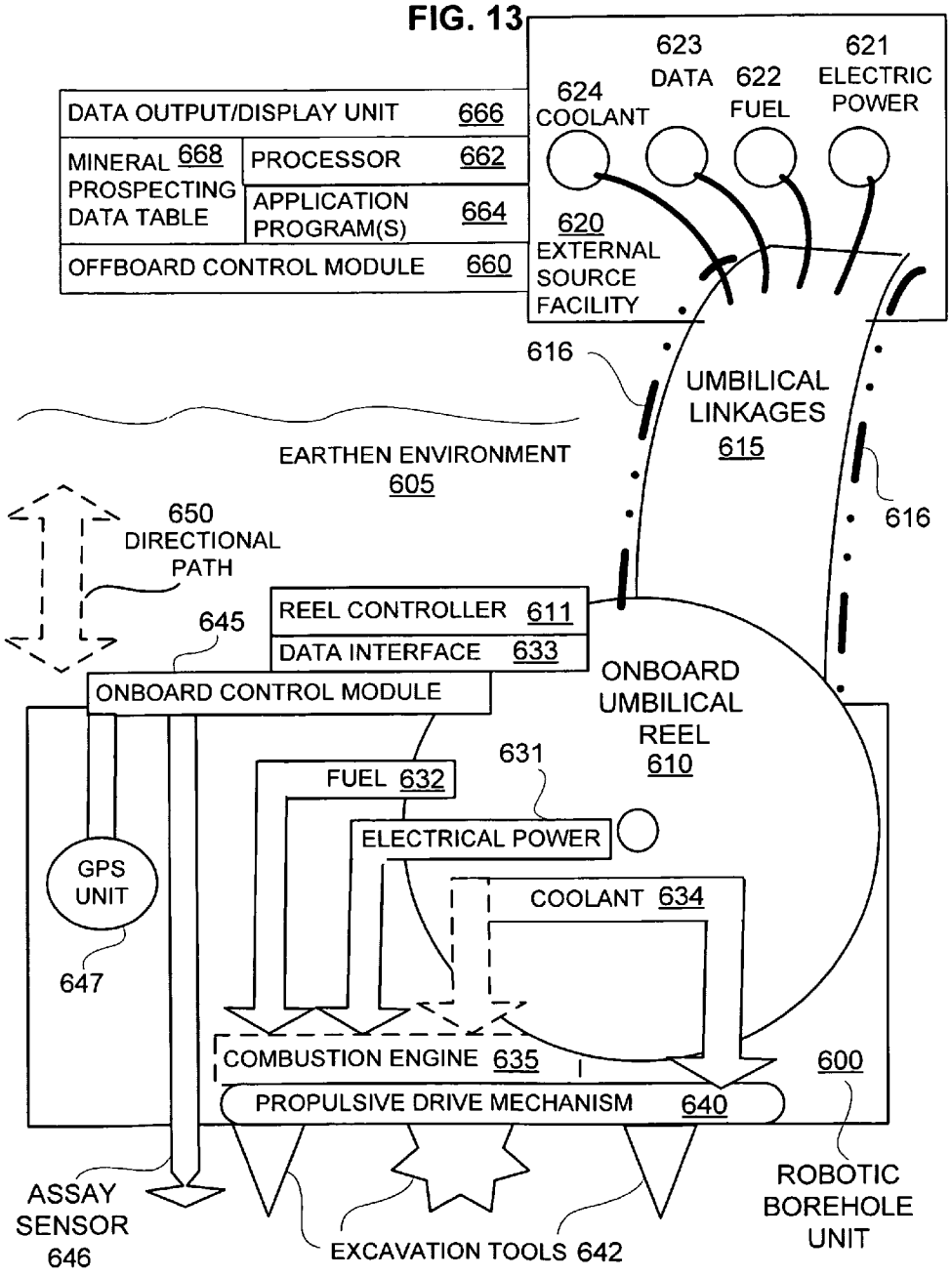
FIGS. 13-14 are schematic system diagrams for embodiment features that include umbilical links to borehole mining components.

FIG. 13 is a schematic system diagram for exemplary embodiment features that include umbilical linkages 615 from an external source facility 620 to an onboard umbilical reel 610 for a robotic borehole unit 600. The external source facility includes processor 662, one or more application programs 664, data output/display unit 666, and offboard control module 660.

The illustrated umbilical linkages 615 include an umbilical branch coupled to an electric power source 621, and another umbilical branch coupled to a fuel source 622, and a further umbilical branch coupled to a data source 623, and an additional umbilical branch coupled to a coolant source 624. A reinforced protective lining 616 is provided for overall tensile strength and to assure the security and integrity of the umbilical branches individually and collectively during prospecting activities in an earthen environment 605 by the robotic borehole unit 600.

In the embodiment of FIG. 13, the robotic borehole unit 600 is pursuing a vertically downward directional path 650 wherein from time to time the robotic borehole unit 600 may by primarily supported by the reinforced protective lining 616 of the umbilical linkages 615. A reel controller 611 provides the necessary coordination required including monitor and control of a direction or rate or timing or restriction or locking or stress-limit parameter during the wind-up retrieval or unwind release of the umbilical linkages 615 from the onboard umbilical reel 610.

The umbilical branch from the electric power source 621 is operatively connected to an electric power conduit 631 that provides operating power to a combustion engine 635; the umbilical branch from the fuel source 622 is operatively connect to a fuel hose 632 that delivers the fuel to a firing chamber in the combustion engine 635; and the umbilical branch from the coolant source 624 is operatively connected to a coolant pipe 634 that distributes the coolant material to appropriate portions of the combustion engine 635. The combustion engine 635 is shown for illustration purposes only, and various other power delivery techniques may be employed as disclosed herein. In this instance the combustion engine 635 activates a propulsive drive mechanism 640 which is operatively coupled to one or more of the same or different types of excavation tools 642. The coolant pipe 634 may also distribute coolant material to appropriate portions of the propulsive drive mechanism 640 which may otherwise experience excessive overheating.

The umbilical branch from data source 623 is operatively connected to an onboard data interface 633, such that an onboard control module 645 can have access to pertinent data information regarding various ongoing or future prospecting activities. Further inputs to the onboard control module 645 may be provided from an onboard GPS (global positioning system) unit 647 as well as from an assay sensor 646. It will be further understood from the various embodiment features disclosed herein that certain exemplary processing functions may be solely provided by a single control module (e.g., either onboard control module 645 or offboard control module 660), and other specified exemplary processing functions may be shared or carried out jointly by more than one control module (e.g., 645 and 660).

Figure 14:
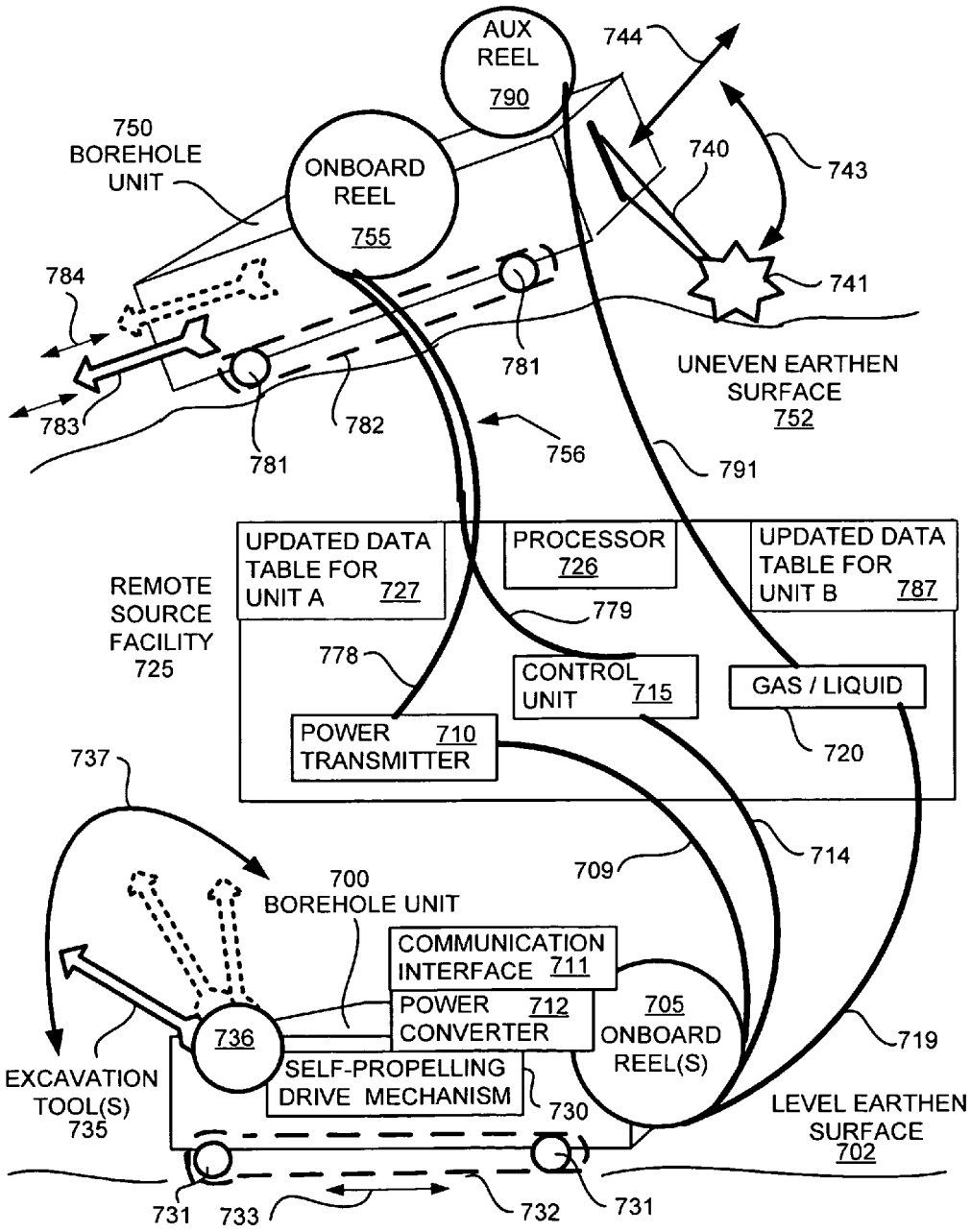

The schematic block diagram of FIG. 14 illustrates further exemplary system aspects regarding possible umbilical links to one or more robotic mining moles. A first borehole unit 700 (also designated "unit A") may be operating along a pathway on an approximately level earthen surface 702. A second borehole unit 750 (also designated "unit B") may be operating in a nearby location along a pathway on an uneven earthen surface 752. Both borehole units 700 and 750 may be monitored and/or managed by a remote source facility 725, wherein umbilicals 709, 714, 719 are housed on one or more onboard reels 705 mounted on borehole unit 700, and umbilicals 778, 779, 791 are housed on onboard reels 755 and auxiliary reel 790.

The remote source facility 725 includes a power transmitter 710, control unit 715, processor 726, and gas/liquid source 720. Separate data records are respectively kept for each borehole unit 700, 750 as indicated by updated data table 727 for "unit A" and updated data table 787 for "unit B". The power transmitter source 710 is operatively connected to borehole unit 700 via umbilical 709, and is further operatively connected to borehole unit 750 via umbilical 778. The control unit 715 is operatively connected to borehole unit 700 via umbilical 714, and further operatively connected to borehole unit 750 via umbilical 779. The gas/liquid source 720 is operatively connected to borehole unit 700 via umbilical 719, and is further operatively connected to borehole unit 750 via umbilical 791 that is housed on auxiliary reel 790.

As shown in FIG. 14, borehole unit 700 includes power converter 712 that receives power via umbilical 709 that may be converted directly or indirectly for delivery to self-propelling drive mechanism 730. One or more drive wheels 731 are coupled to the self-propelling drive mechanism 730 in a manner to provide forward and reverse movement 733 in response to propulsive power applied to a continuous motorized track 730 mounted on drive wheels 731. Also one or more excavation tools 735 are coupled to the self-propelling drive mechanism 730 in a manner to provide propulsive excavation power that breaks down ore deposits for further evaluation and/or testing and/or removal. Directional flexibility for excavation tools 735 may be enabled by rotary mount 736 that may also be driven directly or indirectly from power converter 712.

The borehole unit 700 also includes communication interface 711 that is adapted for sending or receiving data via umbilical 714 that is connected with control unit 715. It is understood that control unit 715 is configured to provide management oversight for the one or more onboard reels 705.

Referring to borehole unit 750, the umbilicals 778, 779 housed on onboard reel 755 may be combined into a dual umbilical 756 to facilitate spooling inwardly and outwardly from their onboard reel 755. Propulsive power for motorized track 782 carried by drive wheels 781 is provided directly or indirectly from umbilical 778 connected from power transmitter 710. Similarly, propulsive power is provided via umbilical 778 for excavation tools 783 that use oscillating movement 784 to break down ore deposits having possible mineral value, as well as to provide a directional passageway along uneven earthen surface 752. A steering capability for borehole unit 750 may be implemented by rearwardly extending arm 740 that includes a high traction support wheel 741. A mechanized pivotal ball joint (not shown) can provide capability for the rearwardly extending arm 750 to rotate vertically 743 as well as laterally 744 in response commands received from control unit 715 via umbilical 779 as well as pursuant to propulsive power supplied directly or indirectly via umbilical 778. It is understood that control unit 715 is further configured to provide management oversight for onboard reel 755 and auxiliary reel 790.

The illustrated system and apparatus example disclosed herein are for purposes of illustration only, and are not intended to be limiting. In that regard, the exemplary system embodiments of FIGS. 1-4 and FIGS. 13-14 provide a robotic-type system for mineral prospecting that includes a control unit adapted for management and/or monitoring of a self-propelled borehole unit that is configured to perform prospecting activity at a workplace along a directional path in an earthen environment; and an umbilical operably connected from an external source to the self-propelled borehole unit, wherein the umbilical includes one or more types of functional linkage components coupled with the self-propelled borehole unit. A further system aspect includes an onboard reel incorporated with the self-propelled borehole unit and configured to carry the umbilical in a manner to enable extending or shortening the umbilical without causing significant relative movement of the umbilical during travel of the self-propelled borehole unit along the directional path.

Other system component features may provide a control unit adapted to cause the umbilical to be spooled outwardly from the onboard reel during forward progress of the self-propelled borehole unit along the directional path, as well as to be spooled inwardly onto the onboard reel during backward regression of the self-propelled borehole unit along the directional path. A related system aspect provides a protective layer for enclosing and/or shielding and/or protecting the functional linkage components during a prospecting activity, as well as during a retrieval of the self-propelled borehole unit from the work place. Another disclosed system feature may provide a borehole unit with an auxiliary support that includes one or more lateral arm members adapted to engage an upper or lower or side wall of a passageway to facilitate travel along the directional path.

In some system embodiments the umbilical may include a reinforcement layer or high strength cable portion for supporting and/or providing tensile strength to the umbilical during a prospecting activity as well as during a retrieval of the self-propelled borehole unit from the work place. Further system features disclosed herein include providing an umbilical that includes an optical power signal line operably coupled to a tool configured to obtain mineral or ore samples along the directional path, as well as operably coupled to a tool configured to assay a mineral or ore sample along the directional path.

Another possible system embodiment feature may provide an extendible slip tube connected to the self-propelled borehole unit and adapted to enable the one or more type of functional linkage components to be protected or collectively pulled to maintain connection of such functional linkages components between the external source and the self-propelled borehole unit. A further system aspect may provide an on-board reel controller adapted to coordinate a direction or rate or timing or restriction or locking or stress-limit for the umbilical during its wind-up retrieval or un-wind release from the onboard reel. The reel controller may be adapted to coordinate the umbilical during its release from or retrieval onto the onboard reel, without undue longitudinal movement of the umbilical relative to the directional path.

Additional system aspects disclosed herein include an energy storage device configured to receive power from the power supply line and deliver power to the self-propelling borehole unit and/or to one or more other power driven loads. A further system component aspect provides a control module that includes computer readable media for executing a method for management and control of the self-propelled borehole unit and/or one or more of its associated tools to perform an excavation or sampling or assay or navigation function along the directional path in the earthen environment.

In a general sense, those skilled in the art will recognize that the various embodiments described herein can be implemented, individually and/or collectively, by various types of electro-mechanical systems having a wide range of electrical components such as hardware, software, firmware, and/or virtually any combination thereof; and a wide range of components that may impart mechanical force or motion such as rigid bodies, spring or torsional bodies, hydraulics, electromagnetically actuated devices, and/or virtually any combination thereof. Consequently, as used herein "electro-mechanical system" includes, but is not limited to, electrical circuitry operably coupled with a transducer (e.g., an actuator, a motor, a piezoelectric crystal, a Micro Electro Mechanical System (MEMS), etc.), electrical circuitry having at least one discrete electrical circuit, electrical circuitry having at least one integrated circuit, electrical circuitry having at least one application specific integrated circuit, electrical circuitry forming a general purpose computing device configured by a computer program (e.g., a general purpose computer configured by a computer program which at least partially carries out processes and/or devices described herein, or a microprocessor configured by a computer program which at least partially carries out processes and/or devices described herein), electrical circuitry forming a memory device (e.g., forms of memory (e.g., random access, flash, read only, etc.)), electrical circuitry forming a communications device (e.g., a modem, communications switch, optical-electrical equipment, etc.), and/or any non-electrical analog thereto, such as optical or other analogs. Those skilled in the art will also appreciate that examples of electro-mechanical systems include but are not limited to a variety of consumer electronics systems, medical devices, as well as other systems such as motorized transport systems, factory automation systems, security systems, and/or communication/computing systems. Those skilled in the art will recognize that electro-mechanical as used herein is not necessarily limited to a system that has both electrical and mechanical actuation except as context may dictate otherwise.

Figure 15:
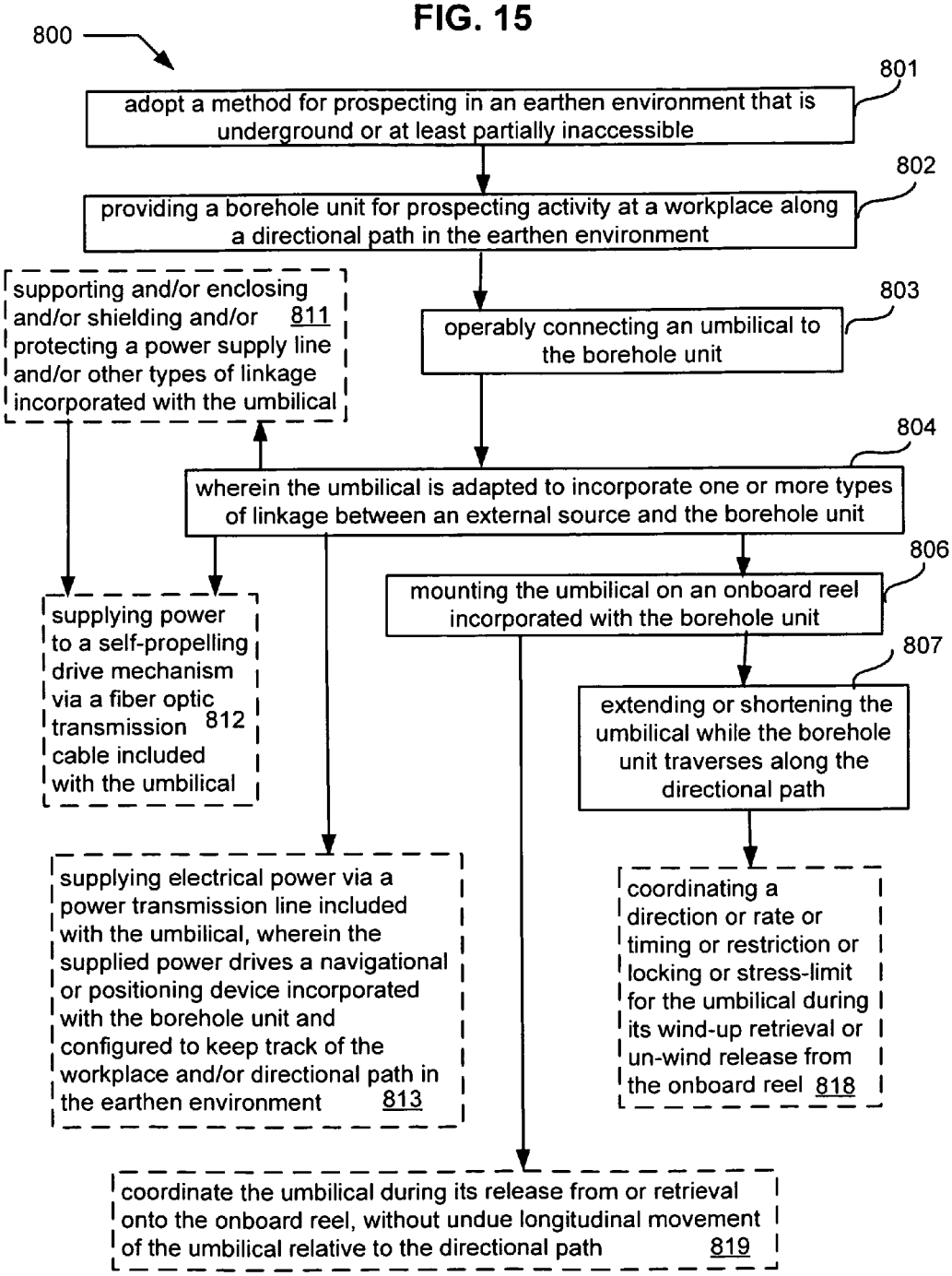
FIG. 15 is a high level flow chart for exemplary process aspects regarding management and control of umbilical connections to borehole mining components.

Referring to the high level flow chart of FIG. 15, an illustrated process embodiment 800 may provide for adoption of a method for prospecting in an earthen environment that is underground or at least partially inaccessible (block 801). Exemplary method operations may include providing a borehole unit for prospecting activity at a workplace along a directional path in the earthen environment (block 802); operably connecting an umbilical to the borehole unit (block 803), wherein the umbilical is adapted to incorporate one or more types of linkage between an external source and the borehole unit (block 804); and mounting the umbilical on an onboard reel incorporated with the borehole unit (block 806). A further exemplary aspect includes extending or shortening the umbilical while the borehole unit traverses along the directional path (block 807).

Additional possible enhancements may include supporting and/or enclosing and/or shielding and/or protecting a power supply line and/or other types of linkage incorporated with the umbilical (block 811). A further example includes supplying propulsive power to a self-propelling drive mechanism via a power supply line included with the umbilical (block 812). Another example includes supplying power via a power transmission line included with the umbilical, wherein the supplied power drives a navigational or positioning device incorporated with the borehole unit and configured to keep track of the workplace and/or directional path in the earthen environment (block 813).

In some instances further process operations may include coordinating a direction or rate or timing or restriction or locking or stress-limit for the umbilical during its wind-up retrieval or un-wind release from the onboard reel (block 818). Additional possible process operations include coordinating the umbilical during its release from or retrieval onto the onboard reel, without undue longitudinal movement of the umbilical relative to the directional path (block 819).

Figure 16:
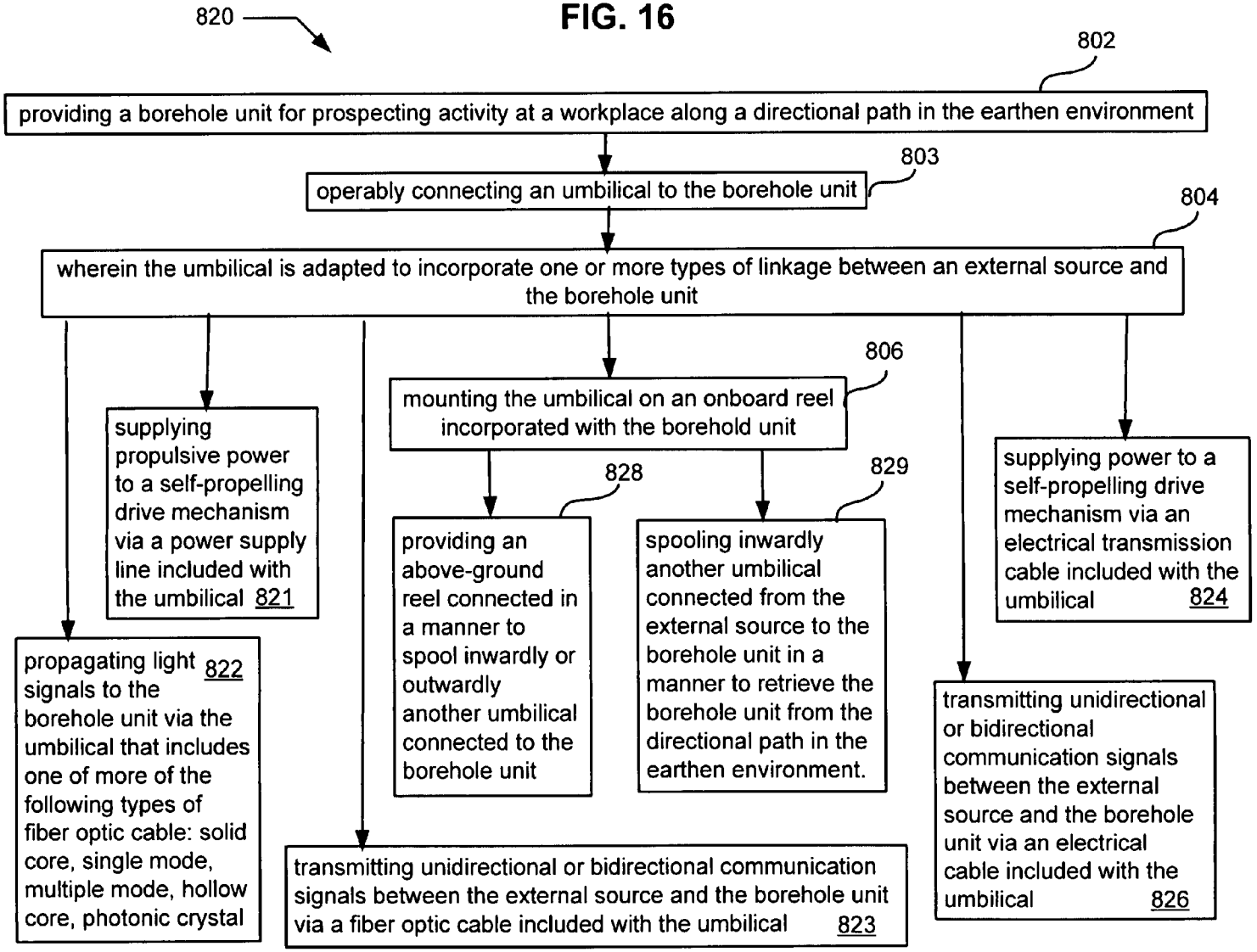
FIGS. 16-22 are detailed flow charts illustrating additional exemplary process aspects regarding umbilical mining techniques.

The detailed flow chart of FIG. 16 illustrates process aspects 820 that include previously described features 802, 803, 804, 806 along with supplying propulsive power to a self-propelling drive mechanism via a power supply line included with the umbilical (block 821). Related aspects may include propagating light signals to the borehole unit via the umbilical that includes one of more of the following types of fiber optic cable: solid core, single mode, multiple mode, hollow core, multiple core, photonic crystal (block 822). Another possibility includes transmitting unidirectional or bidirectional communication signals between the external source and the borehole unit via a fiber optic cable included with the umbilical (block 823).

Further illustrated examples include supplying power to a self-propelling drive mechanism via an electrical transmission cable included with the umbilical (block 824), and in some instances transmitting unidirectional or bidirectional communication signals between the external source and the borehole unit via the electrical transmission cable included with the umbilical (block 826).

Additional aspects related to the umbilical may include providing an above-ground reel connected in a manner to spool inwardly or outwardly another umbilical connected to the borehole unit (block 828). Some embodiment features may include spooling inwardly another umbilical connected from the external source to the borehole unit in a manner to retrieve the borehole unit from the directional path in the earthen environment (block 829).

Figure 17:
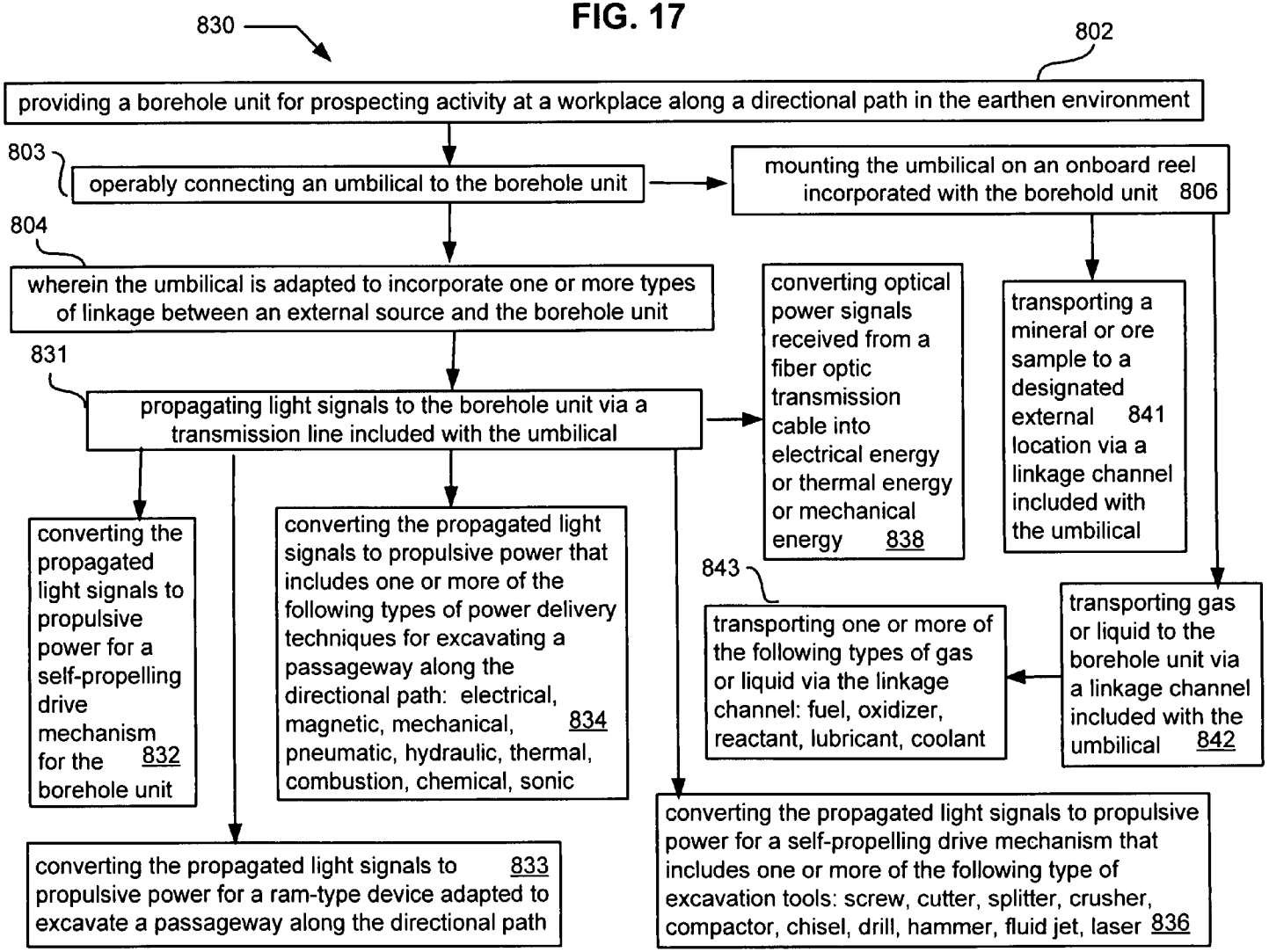

Referring to the illustrated aspects 830 depicted in the flow chart of FIG. 17, various previously described aspects 802, 803, 804, 806 are shown in combination with propagating light signals to the borehole unit via a transmission line included with the umbilical (block 831). Some additional possibilities include converting the propagated light signals to propulsive power for a self-propelling drive mechanism for the borehole unit (block 832), and in some instances converting the propagated light signals to propulsive power for a ram-type device adapted to excavate a passageway along the directional path (block 833).

Further examples include converting the propagated light signals to propulsive power that includes one or more of the following types of power delivery techniques for excavating a passageway along the directional path: electrical, mechanical, magnetic, pneumatic, hydraulic, thermal, combustion, chemical, sonic (block 834). Another example includes converting the propagated light signals to propulsive power for a self-propelling drive mechanism that includes one or more of the following type of excavation tools: screw, cutter, splitter, crusher, compactor, chisel, drill, hammer, fluid jet, laser (block 836).

Other possible process features include converting optical power signals received from the fiber optic transmission cable into electrical energy or thermal energy or mechanical energy (block 838). Additional exemplary aspects include transporting a mineral or ore sample to a designated external location via a linkage channel included with the umbilical (block 841). Also illustrated in FIG. 17 are possible process features that include transporting gas or liquid to the borehole unit via a linkage channel included with the umbilical (block 842), and related possible aspects that include transporting one or more of the following types of gas or liquid via the linkage channel: fuel, oxidizer, reactant, lubricant, coolant (block 843).

Figure 18:
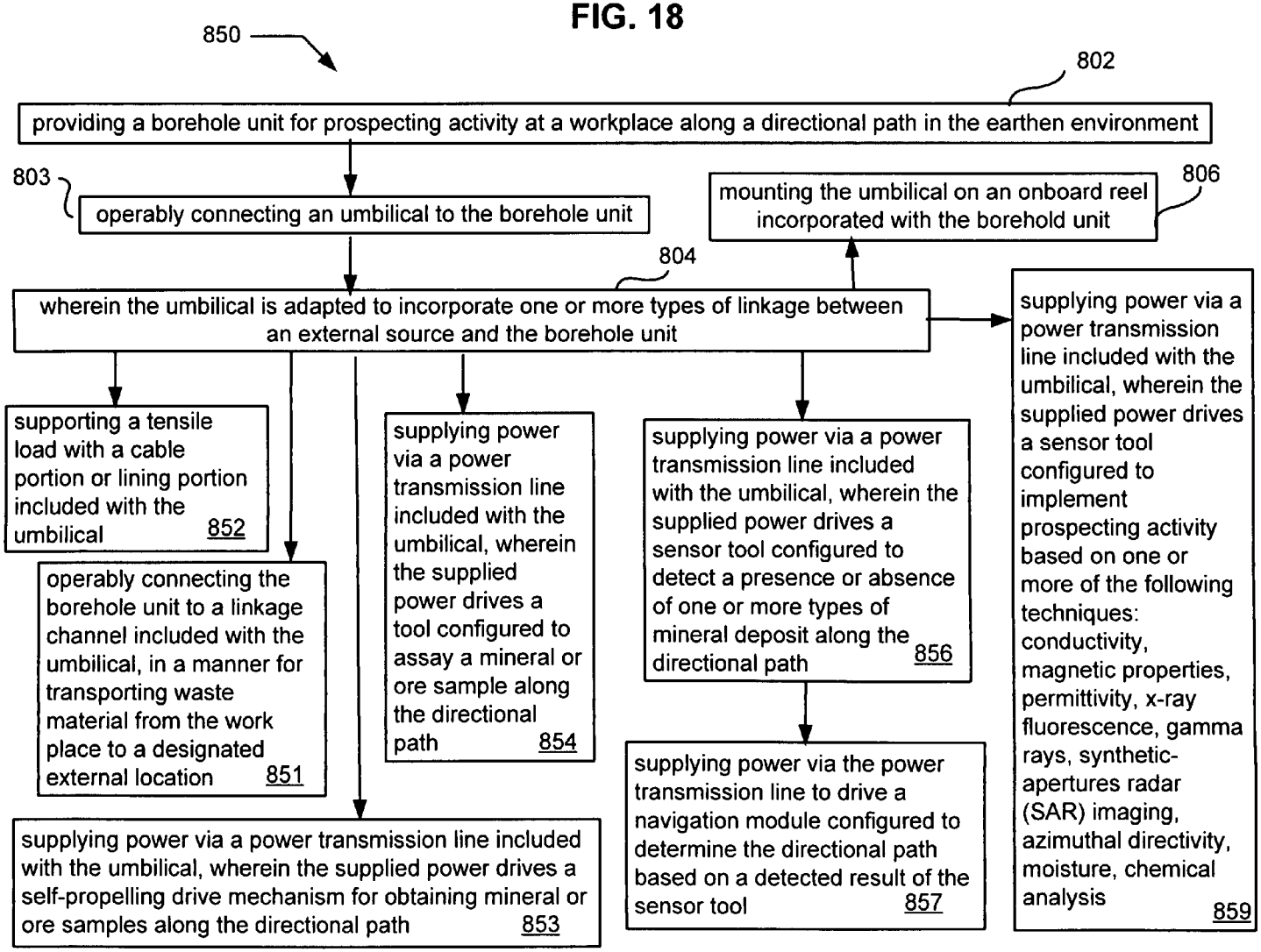

The detailed flow chart of FIG. 18 shows various process examples 850 that include previously described features 802, 803, 804, 806 along with operably connecting the borehole unit to a linkage channel included with the umbilical, in a manner for transporting waste material from the work place to a designated external location (block 851). A further process example includes supporting a tensile load with a cable or lining included with the umbilical (block 852). Another illustrated example includes supplying power via a power transmission line included with the umbilical, wherein the supplied power drives a self-propelling drive mechanism for obtaining mineral or ore samples along the directional path (block 853). In some instances an embodiment feature includes supplying power via a power transmission line included with the umbilical, wherein the supplied power drives a tool configured to assay a mineral or ore sample along the directional path (block 854).

Other possible process aspects include supplying power via a power transmission line included with the umbilical, wherein the supplied power drives a sensor tool configured to detect a presence or absence of one or more types of mineral deposit along the directional path (block 856). A related aspect may include supplying power via the power transmission line to drive a navigation module configured to determine the directional path based on a detected result of the sensor tool (block 857).

Further exemplary enhancements include supplying power via a power transmission line included with the umbilical, wherein the supplied power drives a sensor tool configured to implement prospecting activity based on one or more of the following techniques: conductivity, magnetic properties, permittivity, x-ray fluorescence, gamma rays, synthetic-apertures radar (SAR) imaging, azimuthal directivity, moisture, chemical analysis (block 859).

Figure 19:
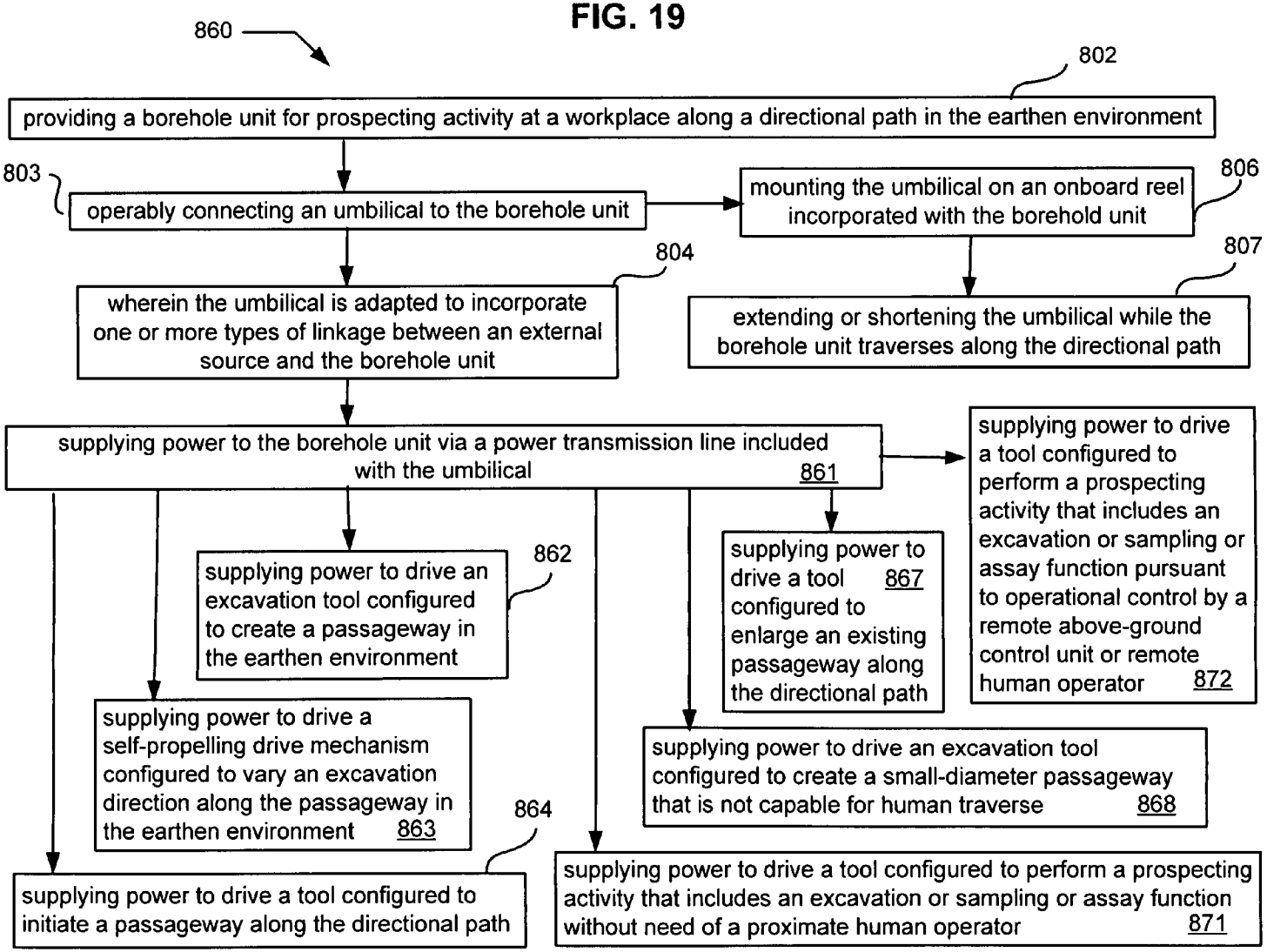

The detailed flow chart of FIG. 19 illustrates process features 860 that include previously described aspects 802, 803, 804, 806, 807 along with supplying power to the borehole unit via a power transmission line included with the umbilical (block 861). Related power supply aspects via the umbilical may include supplying power to drive an excavation tool configured to create a passageway in the earthen environment (block 862); and possibly supplying power via the umbilical to drive a self-propelling drive mechanism configured to vary an excavation direction along the passageway in the earthen environment (block 863), and in some instances supplying power via the umbilical to drive a tool configured to initiate a passageway along the directional path (block 864).

Other embodiment features may include supplying power via a power transmission line included with the umbilical (block 861), wherein the supplied power via the umbilical drives a tool configured to enlarge an existing passageway along the directional path (block 867); and possibly wherein the supplied power via the umbilical drives an excavation tool configured to create a small-diameter passageway that is not capable for human traverse (block 868).

Additional process aspects may include supplying power via a power transmission line included with the umbilical (block 861), wherein the supplied power drives a tool configured to perform a prospecting activity that includes an excavation or sampling or assay function without need of a proximate human operator (block 871). Further examples include supplying power via a power transmission line included with the umbilical, wherein the supplied power drives a tool configured to perform a prospecting activity that includes an excavation or sampling or assay function pursuant to operational control by a remote above-ground control unit or remote human operator (block 872).

Figure 20:
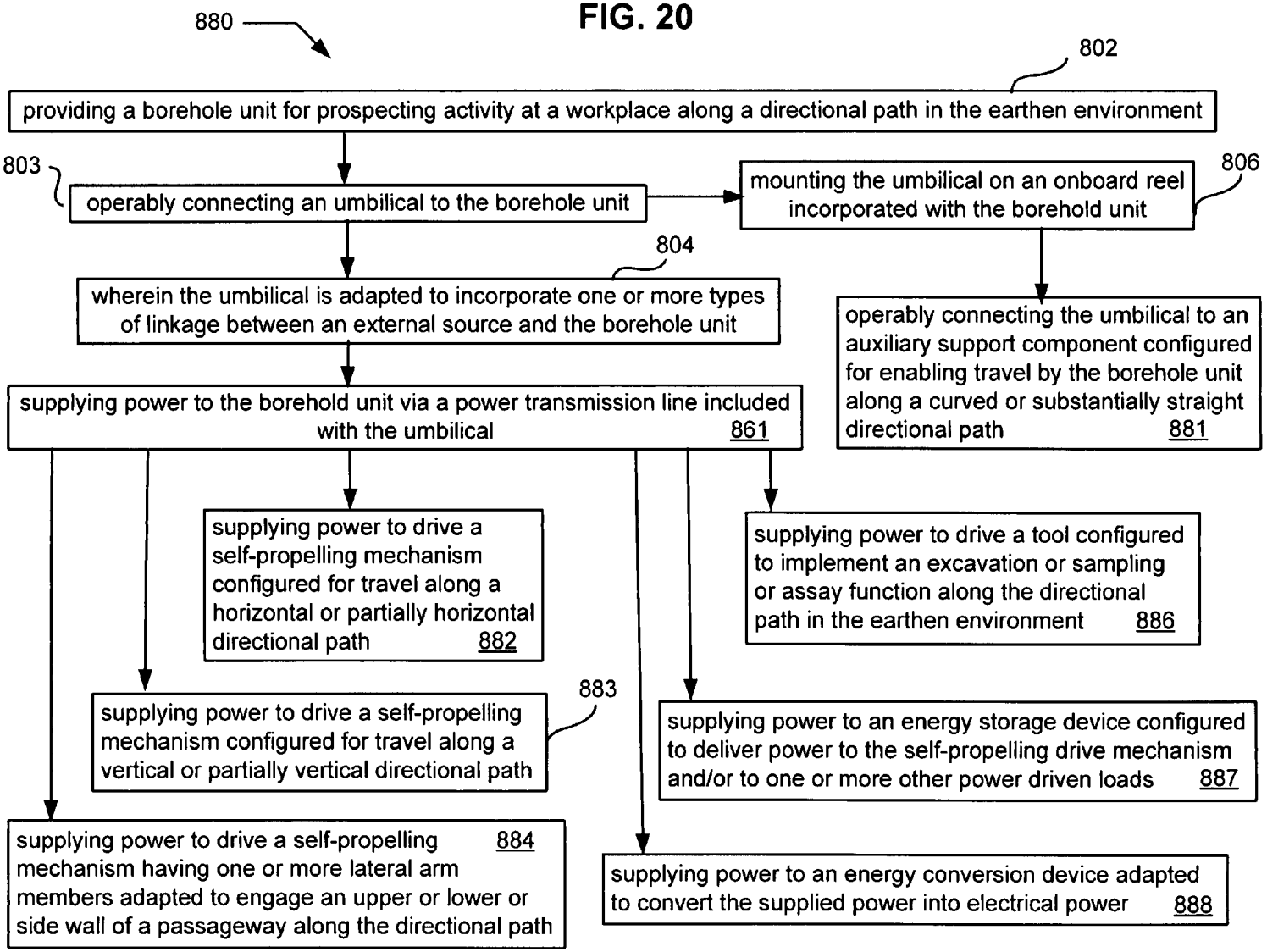

Referring to the detailed flow chart of FIG. 20, various depicted process aspects 880 include previously described features 802, 803, 804, 806 in combination with operably connecting the umbilical to an auxiliary support component configured for enabling travel by the borehole unit along a curved or substantially straight directional path (block 881). Other illustrated examples include supplying power via a power transmission line included with the umbilical (block 861), wherein the supplied power drives a self-propelling mechanism configured for travel along a horizontal or partially horizontal directional path (block 882), and wherein the supplied power via the umbilical may drive a self-propelling mechanism configured for travel along a vertical or partially vertical directional path (block 883).

Further illustrated possibilities include supplying power via a power transmission line included with the umbilical (block 861), wherein the supplied power drives a self-propelling mechanism having one or more lateral arm members adapted to engage an upper or lower or side wall of a passageway along the directional path (block 884). Additional illustrated examples include supplying power via the umbilical to drive a tool configured to implement an excavation or sampling or assay function along the directional path in the earthen environment (block 886).

Another example includes supplying power via a power transmission line included with the umbilical (block 861), to an energy storage device configured to deliver power to the self-propelling drive mechanism and/or to one or more other power driven loads (block 887). In some instances a further process feature may include supplying power via a power transmission line included with the umbilical (block 861), to an energy conversion device adapted to convert the supplied power into electrical power (block 888).

Figure 21:
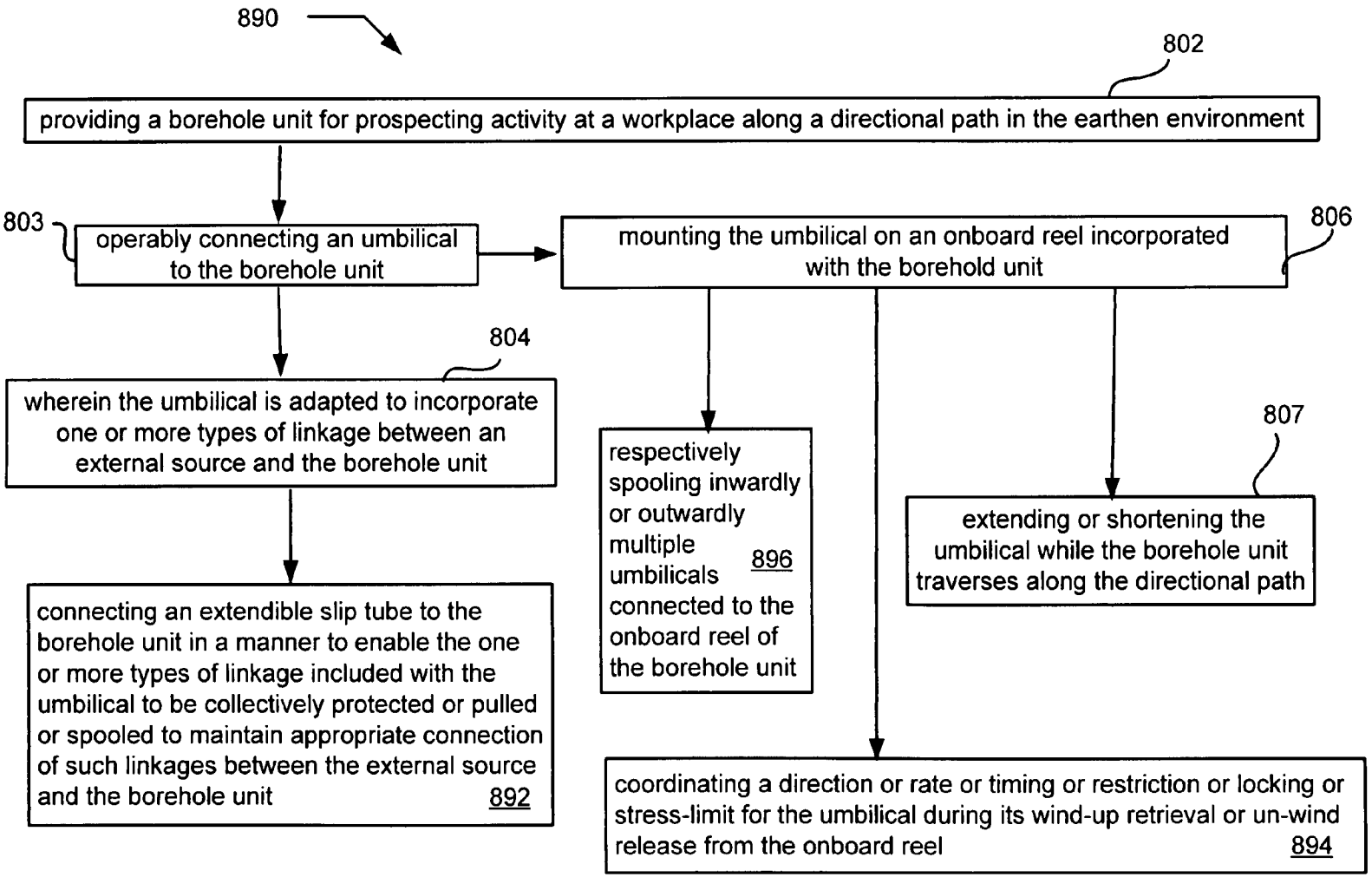

The detailed flow chart of FIG. 21 depicts various exemplary process features 890 that include previously described aspects 802, 803, 804, 806, 807 in combination with connecting an extendible slip tube to the borehole unit in a manner to enable the one or more types of linkage included with the umbilical to be collectively protected or pulled or spooled to maintain appropriate connection of such linkages between the external source and the borehole unit (block 892). A related aspect may include coordinating a direction or rate or timing or restriction or locking or stress-limit for the umbilical during its wind-up retrieval or un-wind release from the onboard reel (block 894). Another illustrated possibility includes respectively spooling inwardly or outwardly multiple umbilicals connected to the onboard reel of the borehole unit (block 896).

Figure 22:
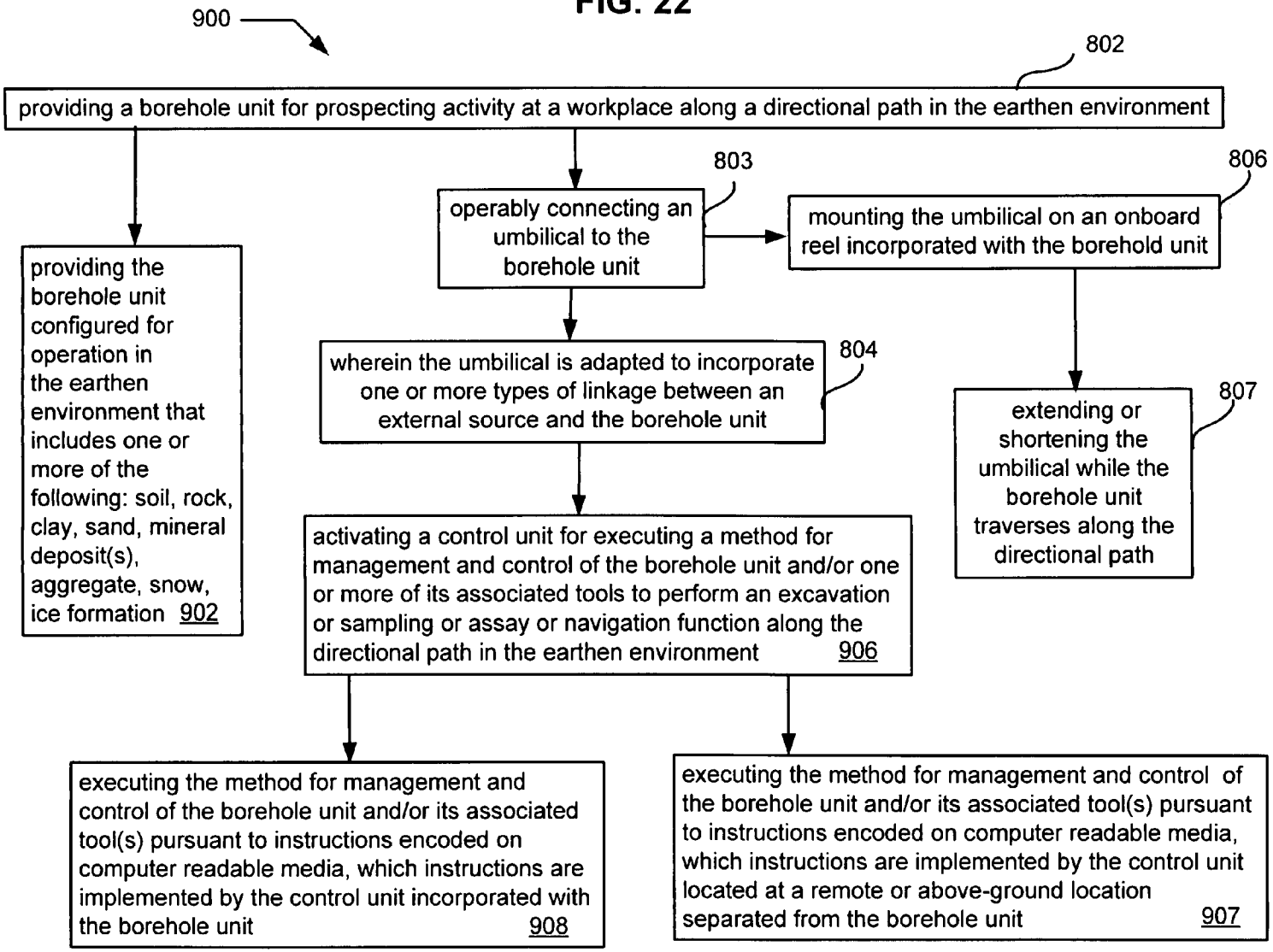

The flow chart of FIG. 22 illustrates addition possible aspects 900 including previously described process features 802, 803, 804, 806, 807 along with providing the borehole unit configured for operation in the earthen environment that includes one or more of the following: soil, rock, clay, sand, mineral deposit(s), aggregate, snow, ice formation (block 902). Another aspect may include activating a control unit for executing a method for management and control of the borehole unit and/or one or more of its associated tools to perform an excavation or sampling or assay or navigation function along the directional path in the earthen environment (block 906).

Additional process aspects may include executing the method for management and control of the borehole unit and/or its associated tool(s) pursuant to instructions encoded on computer readable media, which instructions are implemented by the control unit incorporated with the borehole unit (block 908). In some instances a further exemplary process aspect includes executing the method for such management and control of the borehole unit and/or its associated tool(s) pursuant to instructions encoded on computer readable media, which instructions are implemented by the control unit located at a remote or above-ground location separated from the borehole unit (block 907).

It will be understood from the embodiment disclosed herein that numerous individual method operations depicted in the flow charts of FIGS. 15-22 can be incorporated as encoded instructions in computer readable media in order to obtain enhanced benefits and advantages.

It will be understood by those skilled in the art that the various components and elements disclosed in the system and schematic diagrams herein as well as the various steps and sub-steps disclosed in the flow charts herein may be incorporated together in different claimed combinations in order to enhance possible benefits and advantages.

The exemplary system, apparatus, and computer program product embodiments disclosed herein including FIGS. 1-4 and FIGS. 12-14, along with other components, devices, know-how, skill and techniques known in the art have the capability of implementing and practicing the methods and processes that are depicted in FIGS. 5-11 and FIGS. 15-22

However it is to be further understood by those skilled in the art that other systems, apparatus and technology may be used to implement and practice such methods and processes.

Exemplary methods, systems and components disclosed herein provide propagation of light signals from an external source to a borehole mining mole which includes an optical/electric transducer configured to provide propulsive power for the borehole mining mole and its associated mineral prospecting tools. Some embodiments include one or more umbilicals connected from a remote source location to an onboard reel incorporated with the borehole mining mole. The umbilicals are spooled outwardly or inwardly from the onboard reel during traverse of the borehole mining mole along a path in an earthen environment.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof. In one embodiment, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and or firmware would be well within the skill of one of skill in the art in light of this disclosure. In addition, those skilled in the art will appreciate that the mechanisms of the subject matter described herein are capable of being distributed as a program product in a variety of forms, and that an illustrative embodiment of the subject matter described herein applies regardless of the particular type of signal bearing medium used to actually carry out the distribution. Examples of a signal bearing medium include, but are not limited to, the following: a recordable type medium such as a floppy disk, a hard disk drive, a Compact Disc (CD), a Digital Video Disk (DVD), a digital tape, a computer memory, etc.; and a transmission type medium such as a digital and/or an analog communication medium (e.g., a fiber optic cable, a waveguide, a wired communications link, a wireless communication link (e.g., transmitter, receiver, transmission logic, reception logic, etc.), etc.).

The herein described subject matter sometimes illustrates different components contained within, or connected with, different other components. It is to be understood that such depicted architectures are merely exemplary, and that in fact many other architectures may be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components, and/or wirelessly interactable, and/or wirelessly interacting components, and/or logically interacting, and/or logically interactable components.

In some instances, one or more components may be referred to herein as "configured to," "configured by," "configurable to," "operable/operative to," "adapted/adaptable," "able to," "conformable/conformed to," etc. Those skilled in the art will recognize that such terms (e.g. "configured to") can generally encompass active-state components and/or inactive-state components and/or standby-state components, unless context requires otherwise.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, those skilled in the art will appreciate that recited operations therein may generally be performed in any order. Also, although various operational flows are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

The invention claimed is:

1. A method for prospecting in an earthen environment that is underground or at least partially inaccessible, comprising:

providing a borehole unit for prospecting activity at a workplace along a directional path in the earthen environment;

operably connecting an umbilical to the borehole unit, wherein the umbilical is adapted to incorporate one or more types of linkage between an external source and the borehole unit;

mounting the umbilical on an onboard reel incorporated with the borehole unit; and extending or shortening the umbilical while the borehole unit traverses along the directional path.

2. The method of claim 1 further comprising:

supporting and/or enclosing and/or shielding and/or protecting a power supply line and/or other types of linkage incorporated with the umbilical.

3. The method of claim 1 further comprising:

supplying propulsive power to a self-propelling drive mechanism via a power supply line included with the umbilical.

4. The method of claim 1 further comprising:

supplying power to a self-propelling drive mechanism via a fiber optic transmission cable included with the umbilical.

5. The method of claim 4 further comprising:

converting optical power signals received from the fiber optic transmission cable into electrical energy or thermal energy or mechanical energy.

6. The method of claim 1 wherein said operably connecting the umbilical to the borehole unit includes:

operably connecting the borehole unit to a linkage channel included with the umbilical, in a manner for transporting waste material from the work place to a designated external location.

7. The method of claim 1 further comprising:

transporting a mineral or ore sample to a designated external location via a linkage channel included with the umbilical.

8. The method of claim 1 further comprising:

transporting gas or liquid to the borehole unit via a linkage channel included with the umbilical.

9. The method of claim 8 further comprising:

transporting one or more of the following types of gas or liquid via the linkage channel: fuel, oxidizer, reactant, lubricant, coolant.

10. The method of claim 1 further comprising:

supporting a tensile load with a cable portion or lining portion included with the umbilical.

11. The method of claim 1 further comprising:

providing an above-ground reel connected in a manner to spool inwardly or outwardly another umbilical connected to the borehole unit.

12. The method of claim 1 further comprising:

spooling inwardly another umbilical connected from the external source to the borehole unit in a manner to retrieve the borehole unit from the directional path in the earthen environment.

13. The method of claim 1 further comprising:

connecting an extendible slip tube to the borehole unit in a manner to enable the one or more types of linkage included with the umbilical to be collectively protected or pulled or spooled to maintain appropriate connection of such linkages between the external source and the borehole unit.

14. The method of claim 1 further comprising:

respectively spooling inwardly or outwardly multiple umbilicals connected to the onboard reel of the borehole unit.

15. The method of claim 1 further comprising:

coordinating a direction or rate or timing or restriction or locking or stress-limit for the umbilical during wind-up retrieval or un-wind release from the onboard reel.

16. The method of claim 1 further comprising:

coordinating the umbilical during release from or retrieval onto the onboard reel, without undue longitudinal movement of the umbilical relative to the directional path.

17. The method of claim 1 further comprising:

activating a control unit for executing a method for management and control of the borehole unit and/or one or more tools associated with the borehole unit to perform an excavation or sampling or assay or navigation function along the directional path in the earthen environment.

18. The method of claim 17 further comprising:

executing the method for management and control of the borehole unit and/or the associated tools pursuant to instructions encoded on computer readable media, which instructions are implemented by the control unit incorporated with the borehole unit.

19. The method of claim 17 further comprising:

executing the method for management and control of the borehole unit and/or the associated tools pursuant to instructions encoded on computer readable media, which instructions are implemented by the control unit located at a remote or above-ground location separated from the borehole unit.

20. The method of claim 1 further comprising:

propagating light signals to the borehole unit via the umbilical that includes one of more of the following types of fiber optic cable: solid core, single mode, multiple mode, hollow core, multiple core, photonic crystal.

21. The method of claim 1 further comprising:
transmitting unidirectional or bidirectional communication signals between the external source and the borehole unit via a fiber optic cable included with the umbilical.

22. The method of claim 1 further comprising:
supplying power to a self-propelling drive mechanism via an electrical transmission cable included with the umbilical.

23. The method of claim 22 further comprising:
transmitting unidirectional or bidirectional communication signals between the external source and the borehole unit via the electrical transmission cable included with the umbilical.

24. The method of claim 1 further comprising:
propagating light signals to the borehole unit via a transmission line included with the umbilical.

25. The method of claim 24 further comprising:
converting the propagated light signals to propulsive power for a self-propelling drive mechanism for the borehole unit.

26. The method of claim 24 further comprising:
converting the propagated light signals to propulsive power for a ram-type device adapted to excavate a passageway along the directional path.

27. The method of claim 24 further comprising:
converting the propagated light signals to propulsive power that includes one or more of the following types of power delivery techniques for excavating a passageway along the directional path: electrical, mechanical, magnetic, pneumatic, hydraulic, thermal, combustion, chemical, sonic.

28. The method of claim 24 further comprising:
converting the propagated light signals to propulsive power for a self-propelling drive mechanism that includes one or more of the following type of excavation tools: screw, cutter, splitter, crusher, compactor, chisel, drill, hammer, fluid jet, laser.

29. The method of claim 1 further comprising:
supplying power via a power transmission line included with the umbilical, wherein the supplied power drives a self-propelling drive mechanism for obtaining mineral or ore samples along the directional path.

30. The method of claim 1 further comprising:
supplying power via a power transmission line included with the umbilical, wherein the supplied power drives a tool configured to assay a mineral or ore sample along the directional path.

31. The method of claim 1 further comprising:
supplying power via a power transmission line included with the umbilical, wherein the supplied power drives a sensor tool configured to detect a presence or absence of one or more types of mineral deposit along the directional path.

32. The method of claim 31 further comprising:
supplying power via the power transmission line to drive a navigation module configured to determine the directional path based on a detected result of the sensor tool.

33. The method of claim 1 further comprising:
supplying power via a power transmission line included with the umbilical, wherein the supplied power drives a sensor tool configured to implement prospecting activity based on one or more of the following techniques: conductivity, magnetic properties, permittivity, x-ray fluorescence, gamma rays, synthetic-apertures radar (SAR) imaging, azimuthal directivity, moisture, chemical analysis.

34. The method of claim 1 further comprising:
supplying power via a power transmission line included with the umbilical, wherein the supplied power drives an excavation tool configured to create a passageway in the earthen environment.

35. The method of claim 1 further comprising:
supplying power via a power transmission line included with the umbilical, wherein the supplied power drives a self-propelling drive mechanism configured to vary an excavation direction along the passageway in the earthen environment.

36. The method of claim 1 further comprising:
supplying power via a power transmission line included with the umbilical, wherein the supplied power drives a tool configured to initiate a passageway along the directional path.

37. The method of claim 1 further comprising:
supplying power via a power transmission line included with the umbilical, wherein the supplied power drives a tool configured to enlarge an existing passageway along the directional path.

38. The method of claim 1 further comprising:
supplying power via a power transmission line included with the umbilical, wherein the supplied power drives an excavation tool configured to create a small-diameter passageway that is not capable for human traverse.

39. The method of claim 1 further comprising:
supplying power via a power transmission line included with the umbilical, wherein the supplied power drives a tool configured to perform a prospecting activity that includes an excavation or sampling or assay function without need of a proximate human operator.

40. The method of claim 1 further comprising:
supplying power via a power transmission line included with the umbilical, wherein the supplied power drives a tool configured to perform a prospecting activity that includes an excavation or sampling or assay function pursuant to operational control by a remote above-ground control unit or remote human operator.

41. The method of claim 1 further comprising:
operably connecting the umbilical to an auxiliary support component configured for enabling travel by the borehole unit along a substantially straight directional path.

42. The method of claim 1 further comprising:
operably connecting the umbilical to an auxiliary support component configured for enabling travel by the borehole unit along a curved directional path.

43. The method of claim 1 further comprising:
supplying power via a power transmission line included with the umbilical, wherein the supplied power drives a self-propelling mechanism configured for travel along a horizontal or partially horizontal directional path.

44. The method of claim 1 further comprising:
supplying power via a power transmission line included with the umbilical, wherein the supplied power drives a self-propelling mechanism configured for travel along a vertical or partially vertical directional path.

45. The method of claim 1 further comprising:
supplying power via a power transmission line included with the umbilical, wherein the supplied power drives a self-propelling mechanism having one or more lateral arm members adapted to engage an upper or lower or side wall of a passageway along the directional path.

46. The method of claim 1 further comprising:
supplying power via a power transmission line included with the umbilical, wherein the supplied power drives a navigational or positioning device incorporated with the borehole unit and configured to keep track of the workplace and/or directional path in the earthen environment.

47. The method of claim 1 wherein said method feature providing the borehole unit includes:

providing the borehole unit configured for operation in the earthen environment that includes one or more of the following: soil, rock, clay, sand, mineral deposit(s), aggregate, snow, ice formation.

48. The method of claim 1 further comprising:

supplying power via a power transmission line included with the umbilical, wherein the supplied power drives a tool configured to implement an excavation or sampling or assay function along the directional path in the earthen environment.

49. The method of claim 1 further comprising:

supplying power via a power transmission line included with the umbilical, to an energy storage device configured to deliver power to the self-propelling drive mechanism and/or to one or more other power driven loads.

50. The method of claim 1 further comprising:

supplying power via a power transmission line included with the umbilical, to an energy conversion device adapted to convert the supplied power into electrical power.

51. A robotic-type system for mineral prospecting comprising:

a control unit adapted for management and/or monitoring of a self-propelled borehole unit that is configured to perform prospecting activity at a workplace along a directional path in an earthen environment;

an umbilical operably connected from an external source to the self-propelled borehole unit, wherein the umbilical includes one or more types of functional linkage components coupled with the self-propelled borehole unit; and an onboard reel incorporated with the self-propelled borehole unit and configured to carry the umbilical in a manner to enable extending or shortening the umbilical without causing significant relative movement of the umbilical during travel of the self-propelled borehole unit along the directional path.

52. The system of claim 51, wherein the control unit is adapted to cause the umbilical to be spooled outwardly from the onboard reel during forward progress of the self-propelled borehole unit along the directional path.

53. The system of claim 51, wherein the control unit is adapted to cause the umbilical to be spooled inwardly onto the onboard reel during backward regression of the self-propelled borehole unit along the directional path.

54. The system of claim 51 wherein the umbilical includes:

a protective layer for enclosing and/or shielding and/or protecting the functional linkage components during a prospecting activity.

55. The system of claim 51 wherein the umbilical includes:

a protective layer for enclosing and/or shielding and/or protecting the functional linkage components during a retrieval of the self-propelled borehole unit from the work place.

56. The system of claim 51 wherein the umbilical includes:

a reinforcement layer for supporting and/or providing tensile strength to the umbilical during a prospecting activity.

57. The system of claim 51 wherein the umbilical includes:

a reinforcement layer for supporting and/or providing tensile strength to the umbilical during a retrieval of the self-propelled borehole unit from the work place.

58. The system of claim 51 wherein the functional linkage components include:

a power supply line adapted to supply propulsive power to the self-propelled borehole unit.

59. The system of claim 58 wherein the power supply line includes a fiber optic transmission cable to supply propulsive power to the self-propelled borehole unit.

60. The system of claim 59 further comprising:

a power converter unit to convert optical power signals received from the fiber optic transmission cable into electrical energy or thermal energy or mechanical energy.

61. The system of claim 59 wherein said fiber optic transmission cable includes one of more of the following types of fiber optic cable: solid core, single mode, multiple mode, hollow core, multiple core, photonic crystal.

62. The system of claim 51 wherein said control unit is incorporated with the self-propelled borehole unit.

63. The system of claim 51 wherein said control unit is located remotely from the self-propelled borehole unit.

64. The system of claim 51 wherein the functional linkage components include:

fiber optic cable capable of transmitting unidirectional or bidirectional communication signals between the remotely located control unit and the self-propelled borehole unit.

65. The system of claim 51 further comprising:

an above-ground reel connected to spool inwardly or outwardly another umbilical connected to the self-propelled borehole unit.

66. The system of claim 51 further comprising:

an above-ground reel connected to spool inwardly or outwardly another umbilical connected to the self-propelled borehole unit, in a manner to retrieve the self-propelled borehole unit from the directional path in the earthen environment.

67. The system of claim 51 wherein said umbilical further includes:

an extendible slip tube connected to the self-propelled borehole unit and adapted to enable the one or more type of functional linkage components to be protected or collectively pulled to maintain connection of such functional linkages components between the external source and the self-propelled borehole unit.

68. The system of claim 51 further comprising:

one or more on-board reels for spooling inwardly or outwardly respective umbilicals connected to the self-propelled borehole unit.

69. The system of claim 51 wherein said control unit includes:

an on-board reel controller adapted to coordinate a direction or rate or timing or restriction or locking or stress-limit for the umbilical during wind-up retrieval or unwind release from the onboard reel.

70. The system of claim 51 further comprising:

a reel controller adapted to coordinate the umbilical during release from or retrieval onto the onboard reel, without undue longitudinal movement of the umbilical relative to the directional path.

71. The system of claim 51 wherein said control unit includes:

a control module operably coupled to the self-propelled borehole unit and/or to one or more associated tools to enable management and control of an excavation or sampling or assay function, wherein the control unit is located at a remote or above-ground location separated from the self-propelled borehole unit.

72. The system of claim 71 further comprising:

a wired or wireless communication channel adapted to enable unidirectional and/or bidirectional data transmission between the separated control unit and the self-propelled borehole unit.

73. The system of claim 51 wherein said control unit includes:

a control module that includes computer readable media for executing a method for management and control of the self-propelled borehole unit and/or one or more tools associated with the borehole unit to perform an excavation or sampling or assay or navigation function along the directional path in the earthen environment.

74. The system of claim 51 wherein the functional linkage components include an electrical transmission cable to supply power to the self-propelled borehole unit.

75. The system of claim 51 wherein the electrical transmission cable is configured for transmitting unidirectional or bidirectional communication signals between the external source and the self-propelled borehole unit, in a manner to maintain an updated data table.

76. The system of claim 51 wherein the self-propelled borehole unit includes a ram-type device adapted to excavate a passageway along the directional path.

77. The system of claim 51 wherein the functional linkage components are adapted to provide one or more of the following types of power delivery techniques for excavating a passageway along the directional path: electrical, magnetic, mechanical, pneumatic, hydraulic, thermal, combustion, chemical, sonic.

78. The system of claim 51 wherein the self-propelled borehole unit includes one or more of the following type of excavation tools: screw, cutter, splitter, crusher, compactor, chisel, drill, hammer, fluid jet, laser.

79. The system of claim 51 wherein the functional linkage components include:

a linkage channel adapted for transporting waste material from the work place to a designated external location.

80. The system of claim 51 wherein the functional linkage components include:

a linkage channel adapted for transporting a mineral or ore sample to a designated external location.

81. The system of claim 51 wherein the functional linkage components include:

fluid conduit configured for transporting gas or liquid to the self-propelled borehole unit.

82. The system of claim 51 wherein the functional linkage components include:

a conduit adapted for transporting one or more of the following types of material to the self-propelled borehole unit: fuel, oxidizer, reactant, lubricant, coolant.

83. The system of claim 51 wherein the functional linkage components include:

a cable portion or lining portion configured to support a tensile load.

84. The system of claim 51 wherein the functional linkage components include:

an optical power signal line operably coupled to a tool configured to obtain mineral or ore samples along the directional path.

85. The system of claim 51 wherein the functional linkage components include:

an optical power signal line operably coupled to a tool configured to assay a mineral or ore sample along the directional path.

86. The system of claim 51 wherein the functional linkage components include:

an optical power signal line operably coupled to a sensor tool configured to detect a presence or absence of one or more types of mineral deposit along the directional path.

87. The system of claim 86 further comprising:

a navigation module configured to determine the directional path based on a detected result of the sensor tool.

88. The system of claim 51 wherein the self-propelled borehole unit includes:

a sensor tool configured to implement prospecting activity based on one or more of the following techniques: conductivity, magnetic properties, permittivity, x-ray fluorescence, gamma rays, synthetic-apertures radar (SAR) imaging, aximuthal directivity, moisture, chemical analysis.

89. The system of claim 51 wherein the self-propelled borehole unit includes:

a tool configured to perform a prospecting activity that includes an excavation or sampling or assay function without need of a proximate human operator.

90. The system of claim 51 wherein the self-propelled borehole unit includes:

a tool configured to perform a prospecting activity that includes an excavation or sampling or assay function pursuant to operational control by the control unit.

91. The system of claim 51 wherein the self-propelled borehole unit includes:

an auxiliary support component configured for enabling travel along one or more of the following paths: straight, curved, horizontal, partially horizontal, vertical, partially vertical.

92. The system of claim 51 wherein the self-propelled borehole unit includes:

one or more lateral arm members adapted to engage an upper or lower or side wall of a passageway along the directional path.

93. The system of claim 51 further comprising:

a navigational or positioning device operably coupled with the self-propelled borehole unit and configured to keep track of the workplace and/or directional path in the earthen environment.

94. The system of claim 51 wherein said self-propelled borehole unit is configured for operation in the earthen environment that includes one or more of the following: soil, rock, clay, sand, mineral deposit(s), aggregate, snow, ice formation.

95. The system of claim 51 wherein said umbilical includes a power supply line; and further comprising an energy storage device configured to receive power from the power supply line and deliver power to the self-propelling borehole unit and/or to one or more other power driven loads.

96. The system of claim 51 wherein said umbilical includes a power supply line; and further comprising a power converter configured to convert power received from the power supply line into electrical power.

97. The system of claim 51 wherein said control unit includes:

a control module operably coupled to the borehole unit and/or to one or more associated tools, wherein the control module is incorporated with the self-propelled borehole unit during an excavation or sampling or assay function along the directional path in the earthen environment.

98. The system of claim 97 further comprising:

an antenna included on the self-propelled borehole unit to enable the aforesaid data transmission vie the wireless communication channel.

99. The system of claim 98 further comprising:

a wireless terminal accessible at the remote location of the control unit to enable the aforesaid data transmission vie the wireless communication channel.

100. The system of claim 98 further comprising:

a wireless communication device accessible to a user at the remote location of the control unit to enable unidirectional and/or bidirectional data transmission with the self-propelled borehole unit.

* * * * *